US009011206B2

(12) United States Patent
Ishizu et al.

(10) Patent No.: US 9,011,206 B2
(45) Date of Patent: Apr. 21, 2015

(54) SUPER ABRASIVE WHEEL WITH DISPENSING CAPABILITY, METHOD OF MANUFACTURING WAFER USING THE SAME, AND WAFER

(75) Inventors: Tomohiro Ishizu, Kato (JP); Yukio Okanishi, Osaka (JP); Teruyuki Kumazawa, Kato (JP)

(73) Assignee: A.L.M.T. Corp., Tokyo (JP)

( * ) Notice: Subject to any disclaimer, the term of this patent is extended or adjusted under 35 U.S.C. 154(b) by 241 days.

(21) Appl. No.: 13/519,210

(22) PCT Filed: Jun. 9, 2010

(86) PCT No.: PCT/JP2010/059748

§ 371 (c)(1), (2), (4) Date: Jun. 26, 2012

(87) PCT Pub. No.: WO2011/086715

PCT Pub. Date: Jul. 21, 2011

(65) Prior Publication Data

US 2012/0288677 A1 Nov. 15, 2012

(30) Foreign Application Priority Data

Jan. 13, 2010 (JP) ..... 2010-004998

(51) Int. Cl.
*B24D 7/18* (2006.01)
*B24D 7/06* (2006.01)
(Continued)

(52) U.S. Cl.
CPC .. *B24D 7/06* (2013.01); *B24D 7/10* (2013.01); *B24B 7/228* (2013.01)

(58) Field of Classification Search
CPC ..... B24B 23/00; B24B 7/228; B24D 7/02; B24D 7/06; B24D 7/10; B24D 7/18; B24D 18/0009; B24D 99/005; B24D 5/10
USPC ..... 451/544, 547, 541, 41, 548, 446, 451/285–289
See application file for complete search history.

(56) References Cited

U.S. PATENT DOCUMENTS 2,307,312 A * 1/1943 Whiting ..... 451/548
5,259,148 A * 11/1993 Wiand ..... 451/450
(Continued)

FOREIGN PATENT DOCUMENTS

CN 1178494 A 4/1998
CN 1208682 A 2/1999
(Continued)

OTHER PUBLICATIONS

Chinese Office Action mailed Dec. 31, 2013 for related Chinese Application No. 201080061275.6 with English translation.

*Primary Examiner* — Joseph J Hail
*Assistant Examiner* — Arman Milanian
(74) *Attorney, Agent, or Firm* — Birch, Stewart, Kolasch & Birch, LLP

(57) ABSTRACT

The super abrasive wheel includes a core rotating around a rotation axis and a super abrasive layer bonded to the core. The core has a first surface and a second surface located opposite to the first surface. An annular first protrusion portion protruding in the direction away from the first surface is provided at a portion of the second surface that is surrounded with the super abrasive layer. A reference surface is provided in the second surface on the inside of the first protrusion portion. The height from the reference surface to the first protrusion portion is denoted as A. A top portion having the height B from the reference surface is provided at a portion of the second surface between the first protrusion portion and the super abrasive layer. The height B is greater than the height A.

18 Claims, 36 Drawing Sheets

(51) Int. Cl.
*B24D 7/10* (2006.01)
*B24B 7/22* (2006.01)

(56) References Cited

U.S. PATENT DOCUMENTS

| | | | | |
|---|---|---|---|---|
| 6,095,899 | A * | 8/2000 | Elmar et al. | 451/28 |
| 6,283,845 | B1 | 9/2001 | Fischbacher et al. | |
| 6,692,343 | B2 * | 2/2004 | Hirata et al. | 451/548 |
| 6,755,729 | B2 * | 6/2004 | Buljan et al. | 451/541 |
| 6,966,826 | B2 * | 11/2005 | Suzuki et al. | 451/450 |
| 7,393,268 | B2 * | 7/2008 | Schrottner | 451/449 |
| 2001/0011004 | A1 * | 8/2001 | Yamaguchi et al. | 451/548 |
| 2003/0032382 | A1 * | 2/2003 | Suzuki et al. | 451/450 |

FOREIGN PATENT DOCUMENTS

| | | | | | |
|---|---|---|---|---|---|
| CN | 1263488 | A | | 8/2000 | |
| FR | 2537034 | | * | 12/1982 | B24D 5/16 |
| JP | 60-259378 | A | | 12/1985 | |
| JP | 61-54459 | U | | 4/1986 | |
| JP | 7-31268 | U | | 6/1995 | |
| JP | 2003-19671 | A | | 1/2003 | |
| JP | 2003019671 | A | * | 1/2003 | B24D 3/00 |
| JP | 2005-138235 | A | | 6/2005 | |
| JP | 2008-238389 | A | | 10/2008 | |
| WO | WO 96/23627 | A1 | | 8/1996 | |
| WO | WO 99/54089 | A1 | | 10/1999 | |

* cited by examiner

SUPER ABRASIVE WHEEL WITH DISPENSING CAPABILITY, METHOD OF MANUFACTURING WAFER USING THE SAME, AND WAFER

TECHNICAL FIELD

The present invention relates to a super abrasive wheel, a method of manufacturing a wafer using the same, and a wafer, and more specifically to a grinding wheel having a super abrasive layer.

BACKGROUND ART

Conventional grinding wheels are disclosed, for example, in Japanese Utility-Model Laying-Open No. 7-31268 (PTL 1) and Japanese Patent Laying-Open No. 2003-19671 (PTL 2).

CITATION LIST

Patent Literature

PTL 1: Japanese Utility-Model Laying-Open No. 7-31268
PTL 2: Japanese Patent Laying-Open No. 2003-19671

SUMMARY OF INVENTION

Technical Problem

PTL 1 discloses a grinding wheel capable of supplying sufficient grinding fluid to a contact portion between a workpiece and a segment grindstone. Specifically, the grinding wheel for grinding a surface of a semiconductor wafer and the like is configured to include a segment grindstone and a holding member for holding the segment grindstone. The holding member has a plurality of grinding fluid supply holes and a regulation portion for regulating the momentum of grinding fluid flowing out from the supply holes.

PTL 2 discloses an improvement of a grinding wheel configured such that grinding fluid supply can be utilized efficiently enough to cool the grinding wheel and a workpiece (semiconductor wafer). In the grinding wheel, a grinding fluid reservoir open radially inward is formed on the inner circumference of a base. The radially outward flow of the grinding fluid supplied to the base of the grinding wheel is temporarily blocked at the reservoir and then leaks out toward a super abrasive layer and a workpiece.

In the grinding wheel in PTL 1, the grinding fluid supplied from the supply hole is supplied only to a part and is not always distributed to the entire contact interface between the segment grindstone and the workpiece.

In order to solve the problem above, PTL 2 discloses that a fluid reservoir open radially inward is formed on the inner circumference of the base. However, too much grinding fluid is stored in the fluid reservoir. As a result, if rotation is fast, the rotation is not stable.

The present invention is therefore made in order to solve the problems above. An object of the present invention is to provide a super abrasive wheel capable of uniformly dispersing grinding fluid with stable rotation.

Solution to Problem

A super abrasive wheel according to an aspect of the present invention includes a core configured to rotate around a rotation axis and a super abrasive layer bonded to the core.

The core has a first surface and a second surface located opposite to the first surface. An annular protrusion portion protruding in a direction away from the first surface is provided at a portion of the second surface that is surrounded with the super abrasive layer. A reference surface is provided at a portion of the second surface on the inside of the protrusion portion. The height from the reference surface to the protrusion portion is denoted as A, and a top portion having a height B from the reference surface is provided at a portion of the second surface between the protrusion portion and the super abrasive layer. The height B is greater than the height A.

In the super abrasive wheel configured in this manner, the grinding fluid supplied from the inner circumferential side collides against the annular protrusion portion and diffuses toward the super abrasive layer. As a result, the grinding fluid can be supplied uniformly between the super abrasive layer and a workpiece. In addition, because of the absence of a fluid reservoir in the second surface, the grinding fluid can be prevented from being stored in the fluid reservoir, thereby realizing stable rotation.

Preferably, a wall surface on an inner circumferential side of the protrusion portion is approximately parallel to the rotation axis.

Preferably, a plurality of the protrusion portions are provided on an inner circumferential side of the super abrasive layer, and in the protrusion portions adjacent to each other, the height from the reference surface is lower in the protrusion portion on the inner circumferential side than in the protrusion portion on the outer circumferential side.

Preferably, the height from the reference surface of the protrusion portion located on an innermost circumferential side is 3 mm or more. This is because if the height is less than 3 mm, part of the grinding fluid supplied from the inner circumferential side passes over the annular protrusion portion without colliding against it. The height is most preferably 3 mm or more and 50 mm or less because the function remains the same even if the height exceeds 50 mm.

Preferably, the difference between the height B and the height A is 1 mm or more. If the difference is less than 1 mm, the grinding fluid may not be supplied uniformly to the super abrasive layer. The difference is most preferably 1 mm or more and 50 mm or less because the function remains the same even if the difference exceeds 50 mm.

Preferably, the protrusion portion is shaped like a circular ring.

Preferably, the protrusion portion has a function of making grinding fluid into finer particles and uniformly distributing the grinding fluid.

In a method of manufacturing a wafer according to the present invention, the super abrasive layer of the super abrasive wheel in the foregoing description is brought into contact with a wafer, and the wafer is polished while grinding fluid is supplied from an inner circumferential side of the protrusion portion.

A wafer according to the present invention is manufactured through the method described above.

A super abrasive wheel according to another aspect of the present invention includes a core configured to rotate around a rotation axis and a super abrasive layer bonded to the core. The core has a first surface and a second surface located opposite to the first surface. The super abrasive wheel further includes a protrusion member provided at a portion of the second surface that is surrounded with the super abrasive layer. The protrusion member has an annular protrusion portion that protrudes in a direction away from the first surface. A reference surface is provided at a portion of the second surface on the inside of the protrusion portion. The height from the reference surface to the protrusion portion is denoted as A, and a top portion having a height B from the reference surface is provided at a portion of the second surface between the protrusion portion and the super abrasive layer. The height B is greater than the height A.

In the super abrasive wheel configured in this manner, the grinding fluid supplied from the inner circumferential side collides against the annular protrusion portion of the protrusion member and diffuses toward the super abrasive layer. As a result, the grinding fluid can be supplied uniformly between the super abrasive layer and a workpiece. In addition, because of the absence of a fluid reservoir in the second surface, the grinding fluid can be prevented from being stored in the fluid reservoir, thereby realizing stable rotation.

The protrusion member is separate from the core. Therefore, the protrusion member can be provided on a conventional core without a protrusion portion. Thus, storage of fluid can be prevented, thereby realizing stable rotation.

Preferably, a wall surface on an inner circumferential side of the protrusion portion is approximately parallel to the rotation axis.

Preferably, a plurality of the protrusion portions are provided on an inner circumferential side of the super abrasive layer, and in the protrusion portions adjacent to each other, the height from the reference surface is lower in the protrusion portion on the inner circumferential side than in the protrusion portion on the outer circumferential side.

Preferably, the height from the reference surface of the protrusion portion located on an innermost circumferential side is 3 mm or more.

Preferably, the difference between the height B and the height A is 1 mm or more.

Preferably, the protrusion portion is shaped like a circular ring.

Preferably, the protrusion portion has a function of making grinding fluid into finer particles and uniformly distributing the grinding fluid.

Advantageous Effects of Invention

The present invention provides a super abrasive wheel capable of uniformly supplying grinding fluid between a super abrasive layer and a workpiece. In addition, because of the absence of a reservoir in the second surface, the grinding fluid is prevented from being stored in a reservoir, and stable rotation is thus realized. The present invention also achieves the effect of stably keeping a sharp edge for a long time, thereby achieving a good working surface quality with less burning of a workpiece.

DESCRIPTION OF EMBODIMENTS

Figure 1:
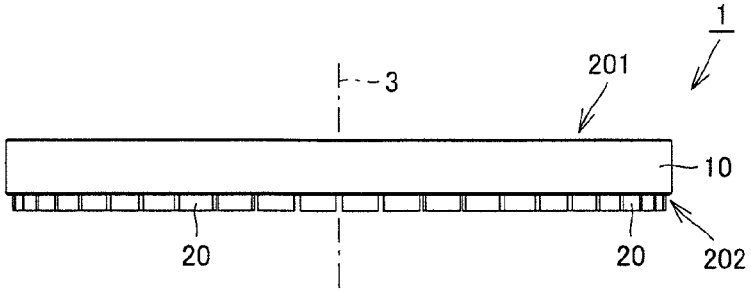
FIG. 1 is a front view of a super abrasive wheel according to a first embodiment of the present invention.

Embodiments of the present invention will be described below with reference to the drawings. It is noted that in the following embodiments the same or corresponding parts are denoted with the same reference numerals and a description thereof will not be repeated. The embodiments can be combined.

First Embodiment

Figure 2:
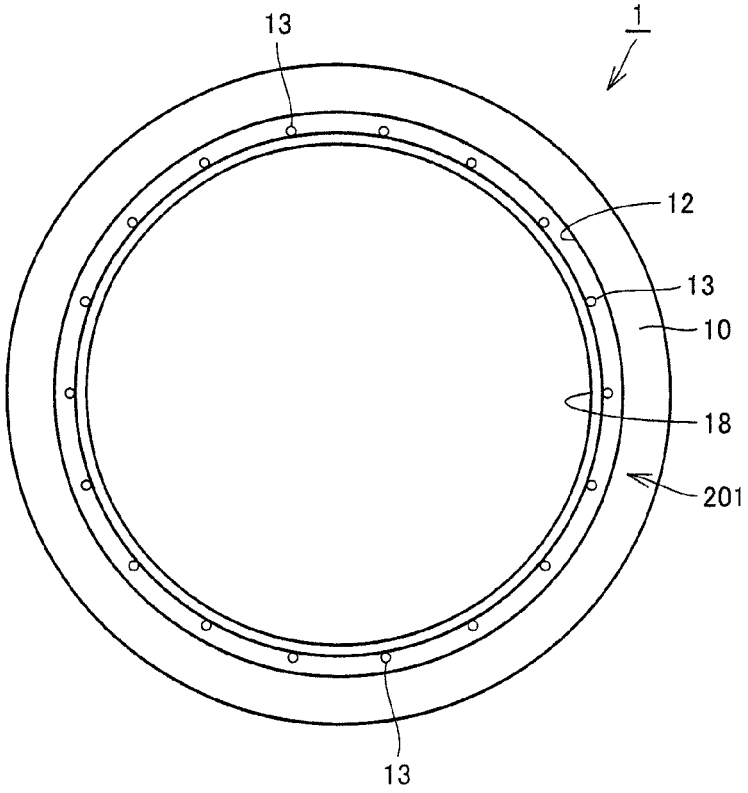
FIG. 2 is a plan view of the super abrasive wheel according to the first embodiment of the invention.
Figure 3:
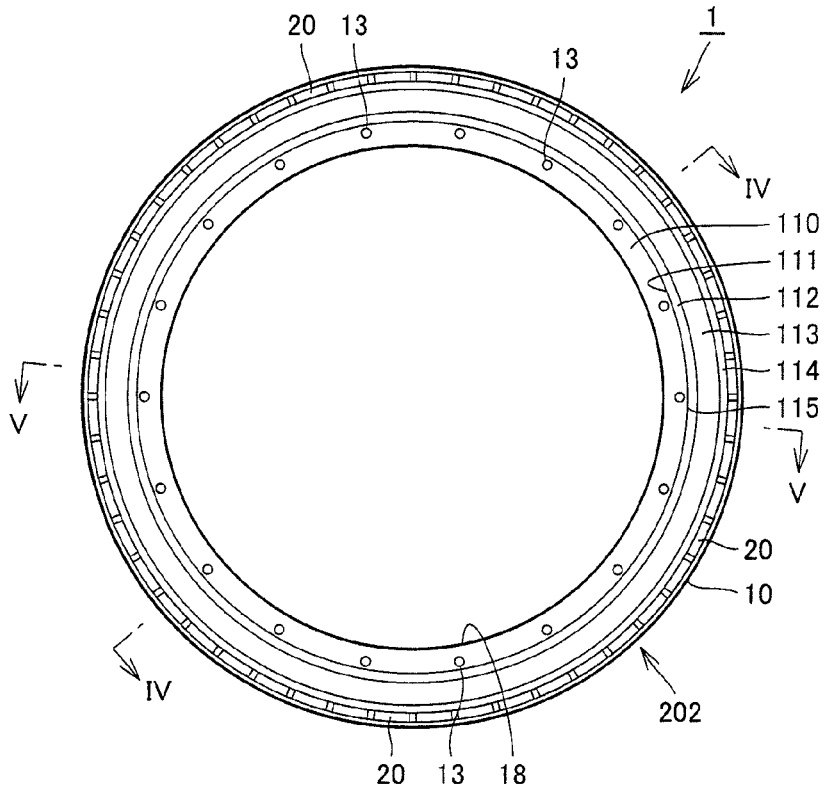
FIG. 3 is a bottom view of the super abrasive wheel according to the first embodiment of the invention.
Figure 4:
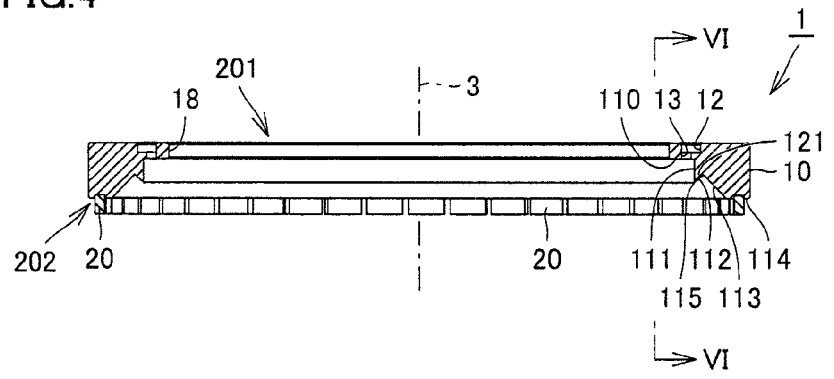
FIG. 4 is a cross-sectional view taken along a line IV-IV in FIG. 3.
Figure 5:
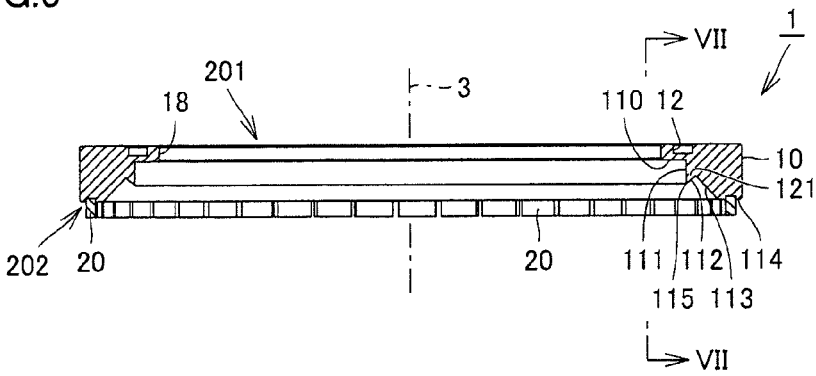
FIG. 5 is a cross-sectional view taken along a line V-V in FIG. 3.
Figure 6:
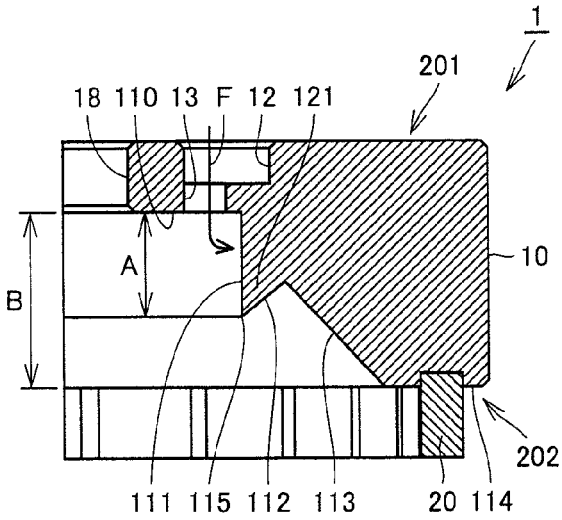
FIG. 6 is an enlarged cross-sectional view showing a portion surrounded by a line VI-VI in FIG. 4.
Figure 7:
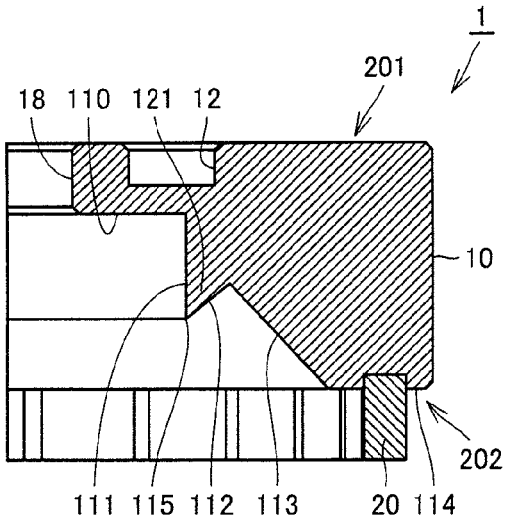
FIG. 7 is an enlarged cross-sectional view showing a portion surrounded by a line VII-VII in FIG. 5.
Figure 8:
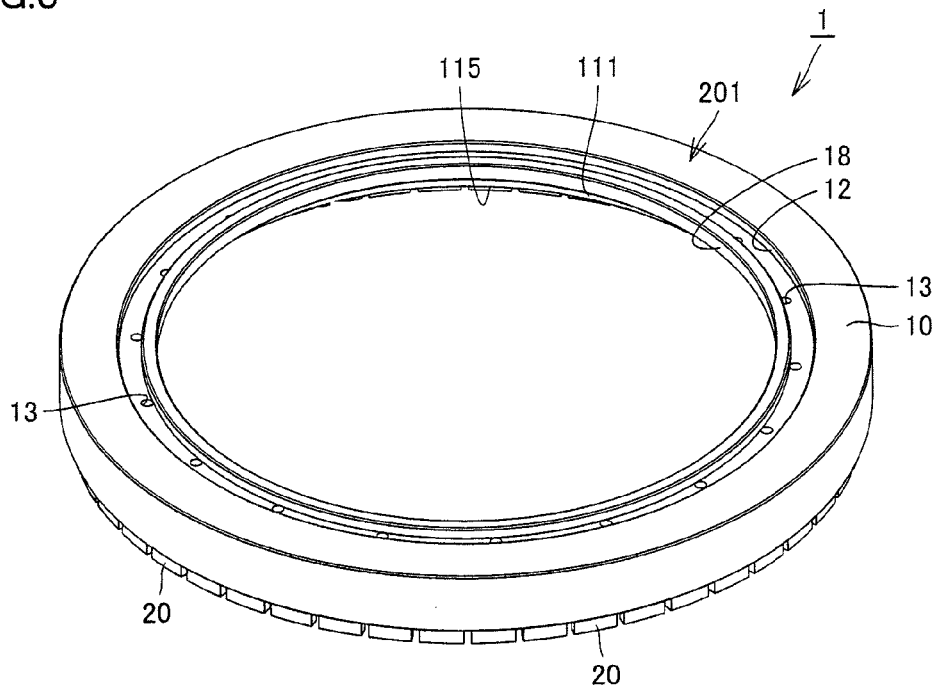
FIG. 8 is a perspective view according to an aspect of the super abrasive wheel according to the first embodiment of the invention.
Figure 9:
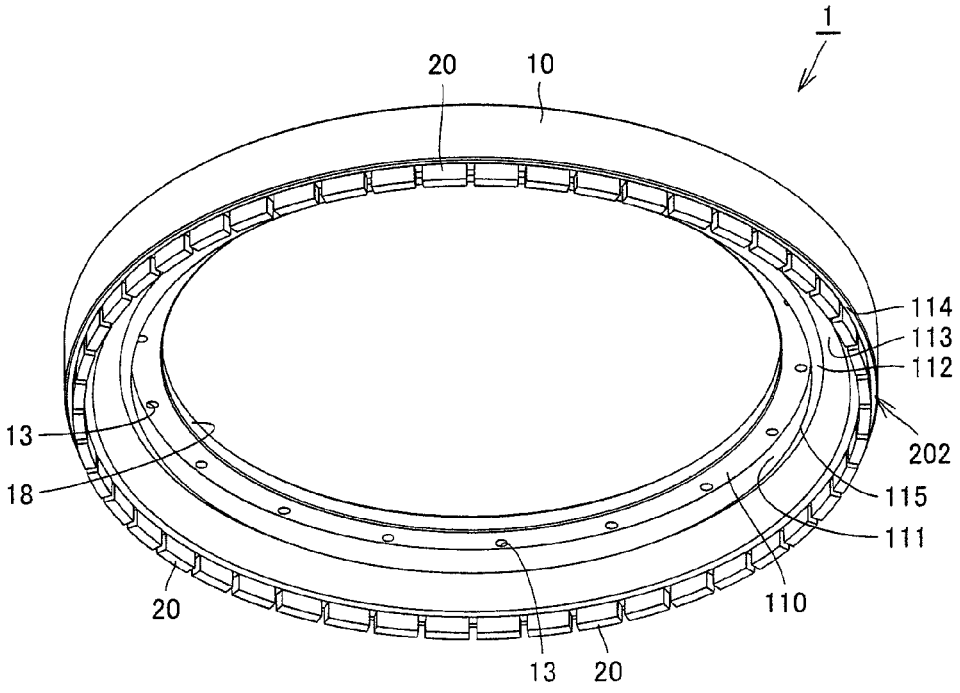
FIG. 9 is a perspective view according to another aspect of the super abrasive wheel according to the first embodiment of the invention.

FIG. 1 is a front view of a super abrasive wheel according to a first embodiment of the present invention. FIG. 2 is a plan view of the super abrasive wheel according to the first embodiment of the invention. FIG. 3 is a bottom view of the super abrasive wheel according to the first embodiment of the invention. FIG. 4 is a cross-sectional view taken along a line IV-IV in FIG. 3. FIG. 5 is a cross-sectional view taken along a line V-V in FIG. 3. FIG. 6 is an enlarged cross-sectional view showing a portion surrounded by a line VI-VI in FIG. 4. FIG. 7 is an enlarged cross-sectional view showing a portion surrounded by a line VII-VII in FIG. 5. FIG. 8 is a perspective view according to an aspect of the super abrasive wheel according to the first embodiment of the invention. FIG. 9 is a perspective view according to another aspect of the super abrasive wheel according to the first embodiment of the invention.

Referring to FIG. 1 to FIG. 9, a super abrasive wheel 1 according to the first embodiment has a ring-shaped core 10. The ring-shaped core 10 rotates around a rotation axis 3. Core 10 has a first surface 201 and a second surface 202 opposite to first surface 201. First surface 201 and second surface 202 define the thickness of core 10. A super abrasive layer 20 is attached to second surface 202. First surface 201 is a surface attached to a working machine. A rotational force from the working machine is transmitted to first surface 201.

A ring-shaped, grinding fluid supply groove 12 is provided on the side having first surface 201. A plurality of grinding fluid supply holes 13 are arranged in grinding fluid supply groove 12. A plurality of grinding fluid supply holes 13 are configured so as to pass through core 10. An inner circumferential wall 18 of core 10 defines a hole, and a spindle is fitted in the hole with a wheel flange interposed.

Grinding fluid supply holes 13 are provided on an inner circumferential portion of second surface 202 of core 10. Grinding fluid supply holes 13 are holes for supplying grinding fluid. A first rising wall 111, a first inverted taper surface 112, and an outer taper surface 113 are arranged in the vicinity of grinding fluid supply holes 13. First rising wall 111 and inverted taper surface 112 form a first protrusion portion 121. An end portion 115 of first protrusion portion 121 serves as a boundary between first rising wall 111 and first inverted taper surface 112. Super abrasive layer 20 having super abrasive bonded with a binder is fixed to a top portion 114 of second surface 202.

Mainly referring to FIG. 6 and FIG. 7, grinding fluid is supplied from grinding fluid supply hole 13 in the direction shown by an arrow F. The grinding fluid receives centrifugal force in the outward direction as core 10 rotates. Then, the grinding fluid moves downward along first rising wall 111 as it moves in the downward direction due to gravity. The grinding fluid, passing through first rising wall 111, diffuses from end portion 115 toward the outer circumference and reaches outer taper surface 113. The grinding fluid then diffuses on outer taper surface 113 to be supplied to super abrasive layer 20. The supplied grinding fluid is supplied to the contact interface between super abrasive layer 20 and the workpiece and serves a function of lubricating and cooling the contact interface.

As shown in FIG. 8 and FIG. 9, first rising wall 111, first inverted taper surface 112, and outer taper surface 113 are each configured so as to extend in the circumferential direction of the circular core 10.

As for the relation between a height A from a reference surface 110 to end portion 115 and a height B from reference surface 110 to top portion 114 as shown in FIG. 6 and FIG. 7, the difference between height A and height B is preferably 1 mm or more. Height A is preferably 3 mm or more.

Super abrasive wheel 1 according to the first embodiment includes core 10 rotating around rotation axis 3 and super abrasive layer 20 bonded to the core. Core 10 has first surface 201 and second surface 202 located opposite to first surface 201. At a portion of second surface 202 that is surrounded with super abrasive layer 20, the annular first protrusion portion 121 is provided which protrudes in the direction away from first surface 201. Reference surface 110 is provided at a portion of second surface 202 on the inside of first protrusion portion 121. The height from reference surface 110 to the first protrusion portion is denoted as A. Top portion 114 having height B from reference surface 110 is provided at a portion of second surface 202 between first protrusion portion 121 and super abrasive layer 20. Height B is greater than height A.

In super abrasive wheel 1 configured in this manner, the grinding fluid supplied from the inner circumferential side collides against the annular first protrusion portion 121 and finely diffuses toward super abrasive layer 20. As a result, the grinding fluid can be supplied uniformly between super abrasive layer 20 and the workpiece. Since a fluid reservoir is not provided at first rising wall 111, the grinding fluid can be prevented from being stored in the fluid reservoir, thereby realizing stable rotation. First rising wall 111 which is a wall surface on the inner circumferential side of first protrusion portion 121 is parallel to rotation axis 3. Height A from reference surface 110 of first protrusion portion 121 located on the innermost circumferential side is 3 mm or more. The difference between height B and height A is 1 mm or more. First protrusion portion 121 is shaped like a circular ring. First protrusion portion 121 has a function of making the grinding fluid into finer particles and diffusing the grinding fluid uniformly.

Second Embodiment

Figure 10:
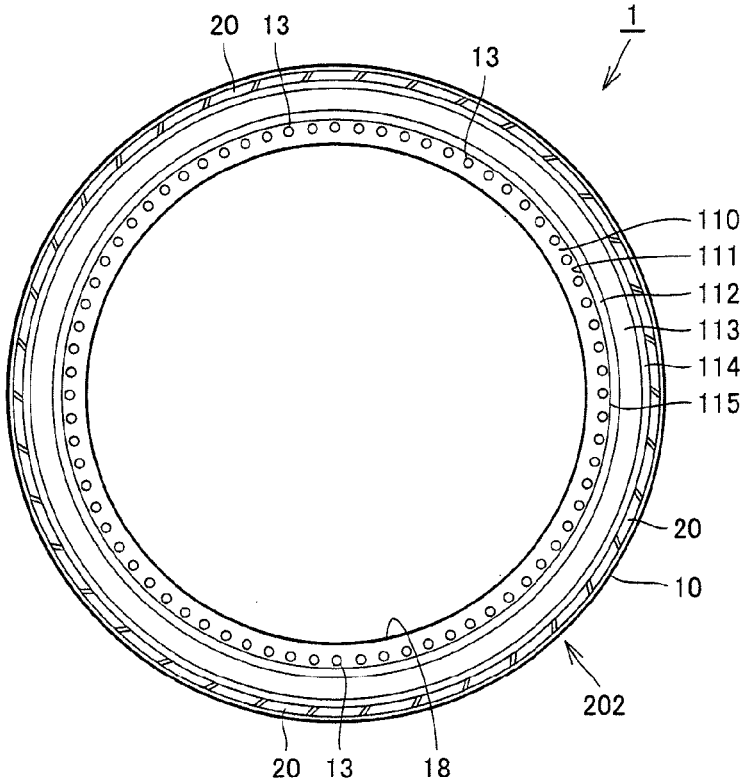
FIG. 10 is a bottom view of the super abrasive wheel according to a second embodiment of the invention.

FIG. 10 is a bottom view of the super abrasive wheel according to a second embodiment of the invention. Referring to FIG. 10, super abrasive wheel 1 according to the second embodiment of the invention differs from the super abrasive wheel according to the first embodiment, which has the approximately rectangular super abrasive layer 20, in that the shape of the working surface of super abrasive layer 20 is an approximate parallelogram.

The super abrasive wheel according to the second embodiment configured in this manner also achieves the similar effect as the super abrasive wheel according to the first embodiment.

Third Embodiment

Figure 11:
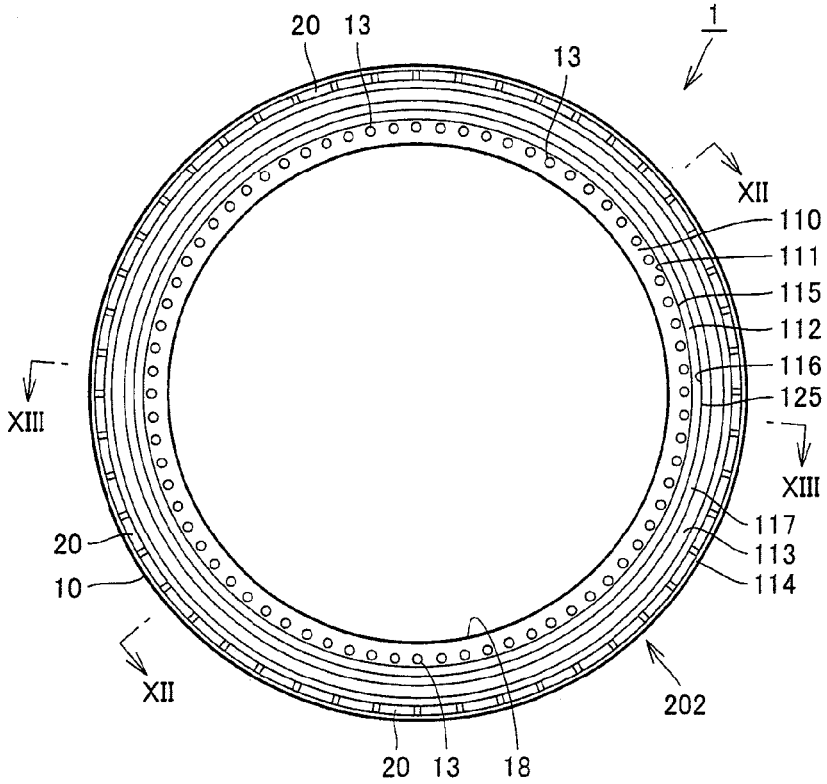
FIG. 11 is a bottom view of the super abrasive wheel according to a third embodiment of the invention.
Figure 12:
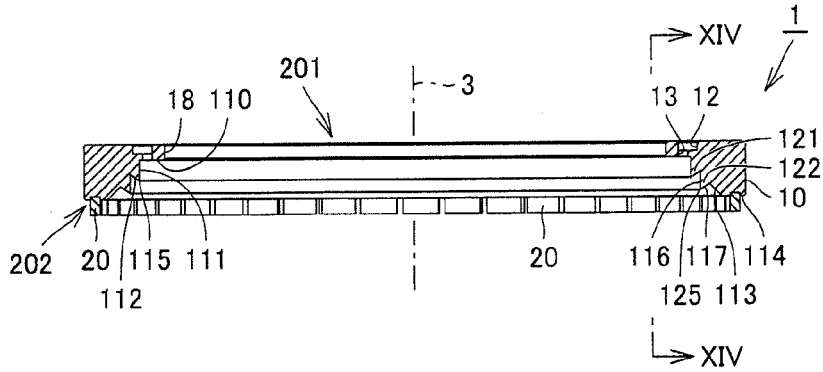
FIG. 12 is a cross-sectional view taken along a line XII-XII in FIG. 11.
Figure 13:
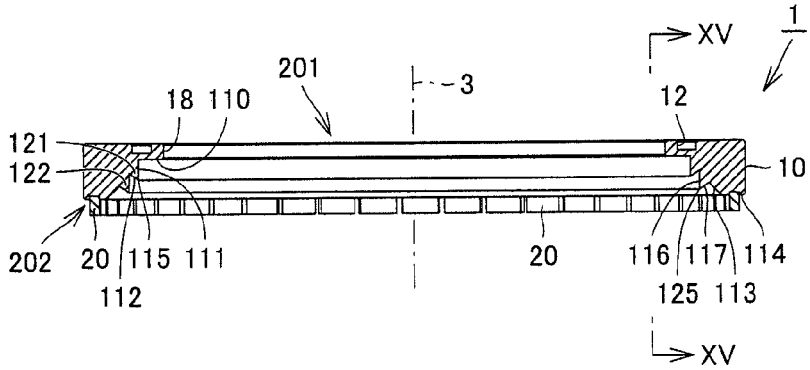
FIG. 13 is a cross-sectional view taken along a line XIII-XIII in FIG. 11.
Figure 14:
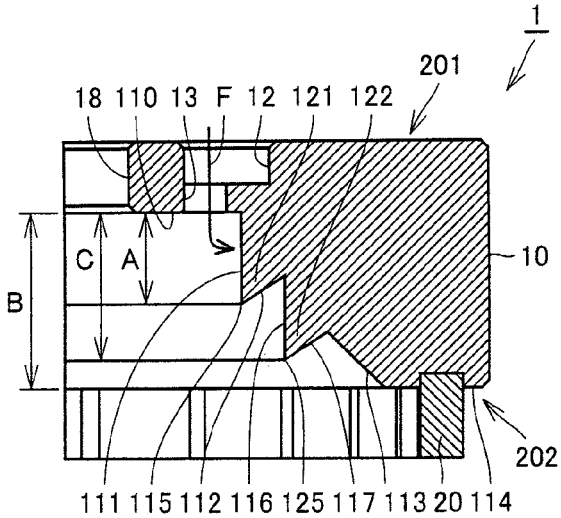
FIG. 14 is an enlarged cross-sectional view showing a portion surrounded by a line XIV-XIV in FIG. 12.
Figure 15:
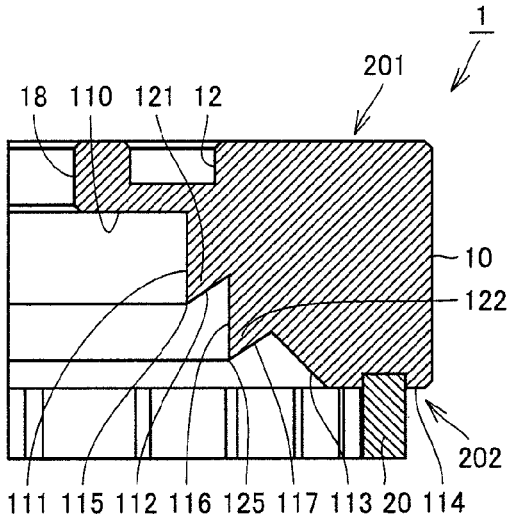
FIG. 15 is an enlarged cross-sectional view showing a portion surrounded by a line XV-XV in FIG. 13.
Figure 16:
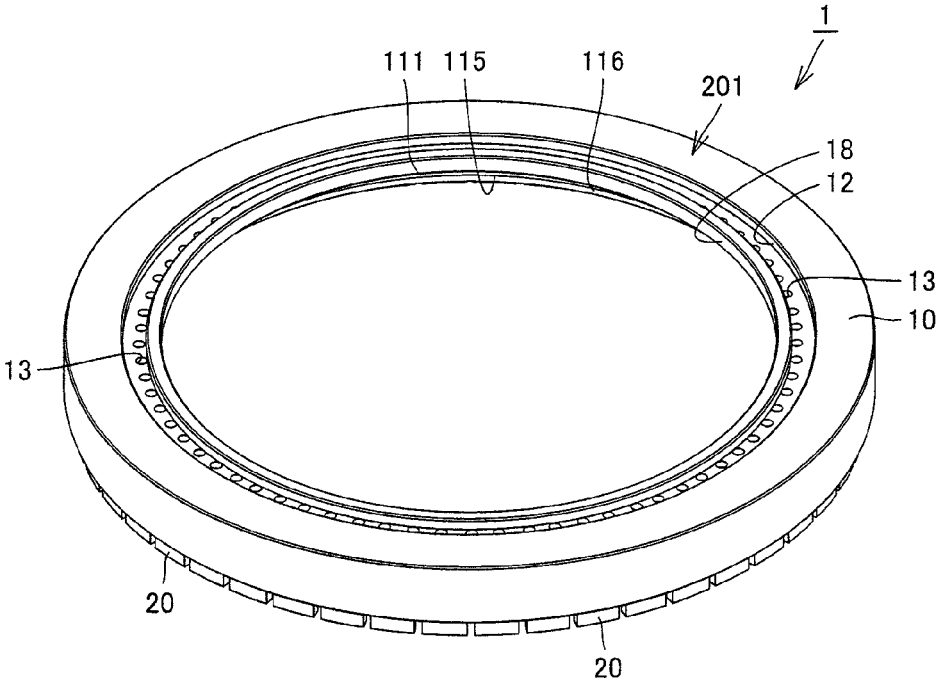
FIG. 16 is a perspective view according to an aspect of the super abrasive wheel according to the third embodiment of the invention.
Figure 17:
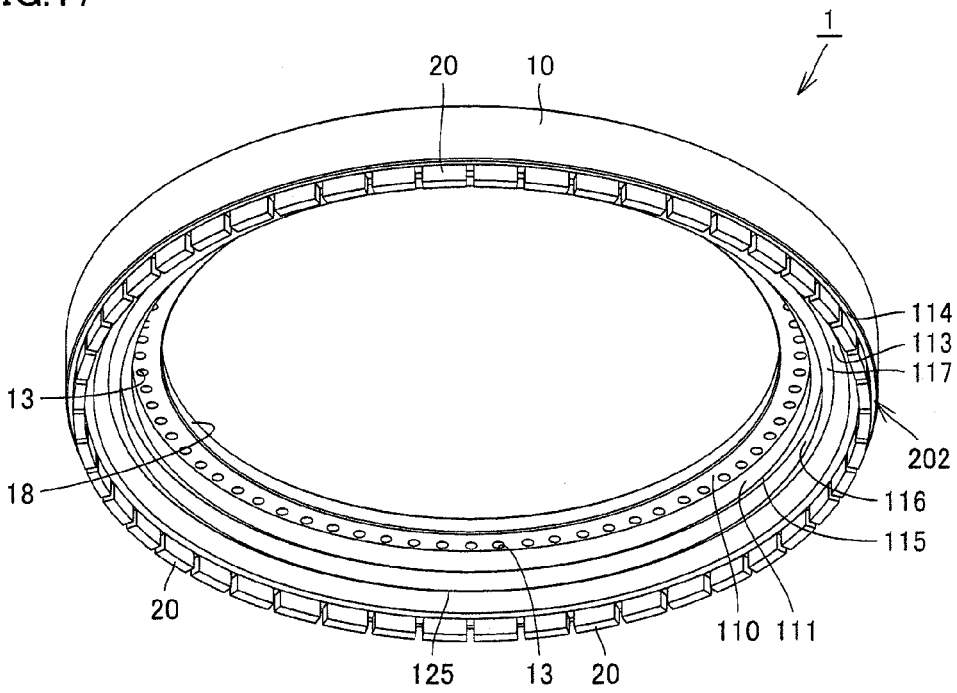
FIG. 17 is a perspective view according to another aspect of the super abrasive wheel according to the third embodiment of the invention.

FIG. 11 is a bottom view of the super abrasive wheel according to a third embodiment of the invention. FIG. 12 is a cross-sectional view taken along a line XII-XII in FIG. 11. FIG. 13 is a cross-sectional view taken along a line XIII-XIII in FIG. 11. FIG. 14 is an enlarged view showing part of the core surrounded by a line XIV-XIV in FIG. 12. FIG. 15 is an enlarged cross-sectional view showing a portion surrounded by a line XV-XV in FIG. 13. FIG. 16 is a perspective view according to an aspect of the super abrasive wheel according to the third embodiment of the invention. FIG. 17 is a perspective view according to another aspect of the super abrasive wheel according to the third embodiment of the invention. Referring to these drawings, the super abrasive wheel according to the third embodiment of the invention differs from the super abrasive wheel according to the first embodiment in that second surface 202 has first rising wall 111, first inverted taper surface 112, a second rising wall 116 and a second inverted taper surface 117, and outer taper surface 113 in order from the inner circumferential side.

More specifically, second rising wall 116 and second inverted taper surface 117 are not provided in the super abrasive wheel according to the first embodiment, whereas they are provided in the third embodiment. First and second protrusion portions 121 and 122 are provided on the inner circumferential side of super abrasive layer 20. In the adjacent first and second protrusion portions 121 and 122, the height from reference surface 110 of first protrusion portion 121 on the inner circumferential side is lower than that of second protrusion portion 122 on the outer circumferential side. First rising wall 111 and second rising wall 116 are arranged generally parallel to the rotation axis and serve a function of temporarily blocking a flow of grinding fluid supplied from the inner circumferential side, and scattering the grinding fluid. The height from reference surface 110 to end portion 115 of first rising wall 111 is denoted as A, the height from reference surface 110 to top portion 114 is denoted as B, and the height from reference surface 110 to end portion 125 is denoted as C. Because of provision of two protrusion portions, namely, first protrusion portion 121 and second protrusion portion 122, the grinding fluid can be dispersed more reliably. More specifically, the grinding fluid supplied from grinding fluid supply hole 13 temporarily flows in the downward direction along first rising wall 111, diffuses from end portion 115, and scatters in the outer circumferential direction. Then, the scattered grinding fluid collides against second rising wall 116, and the grinding fluid flows further downward and scatters from end portion 125 in the outer circumferential direction. As a result, the grinding fluid can be made into finer particles and diffused outward more reliably than in the first embodiment.

Fourth Embodiment

Figure 18:
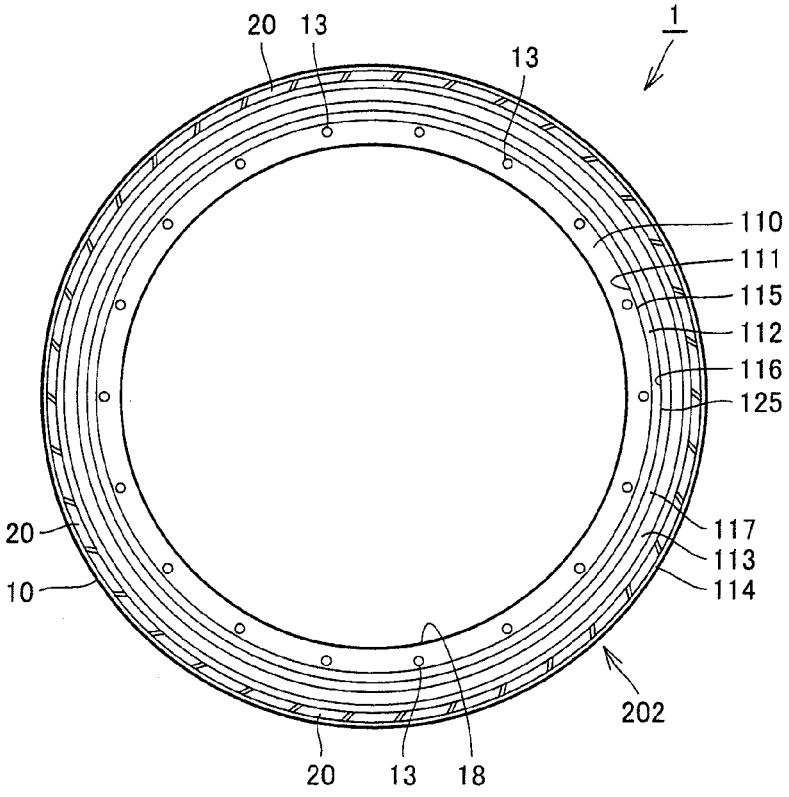
FIG. 18 is a bottom view of the super abrasive wheel according to a fourth embodiment of the invention.

FIG. 18 is a bottom view of the super abrasive wheel according to a fourth embodiment of the invention. Referring to FIG. 18, the super abrasive wheel according to the fourth embodiment of the invention differs from the super abrasive wheel according to the third embodiment in that the shape of the working surface of super abrasive layer 20 is an approximate parallelogram.

Fifth Embodiment

Figure 19:
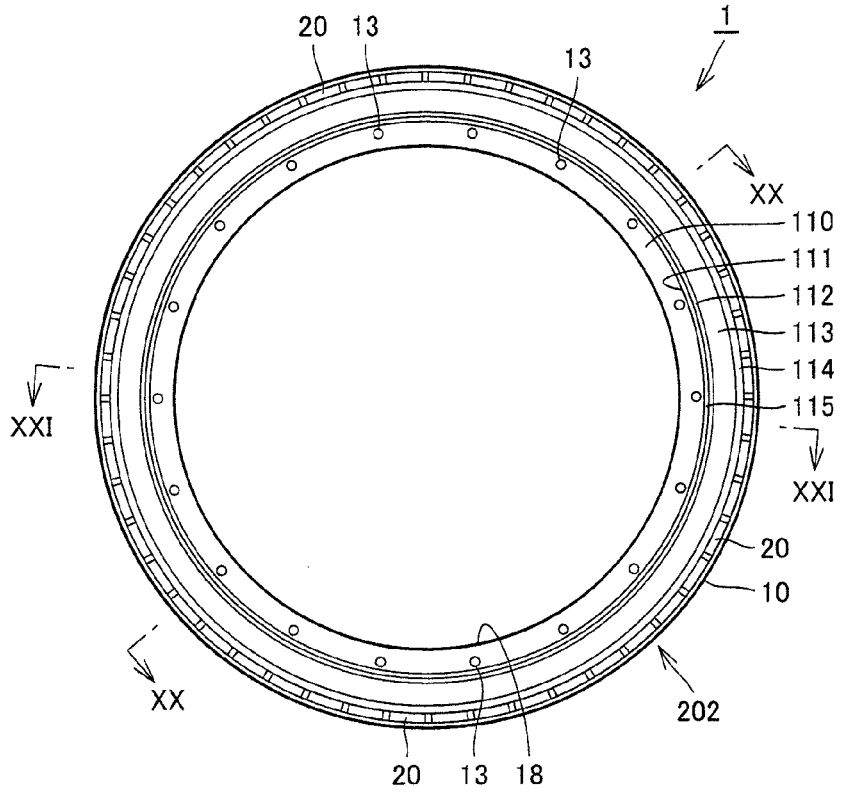
FIG. 19 is a bottom view of the super abrasive wheel according to a fifth embodiment of the invention.
Figure 20:
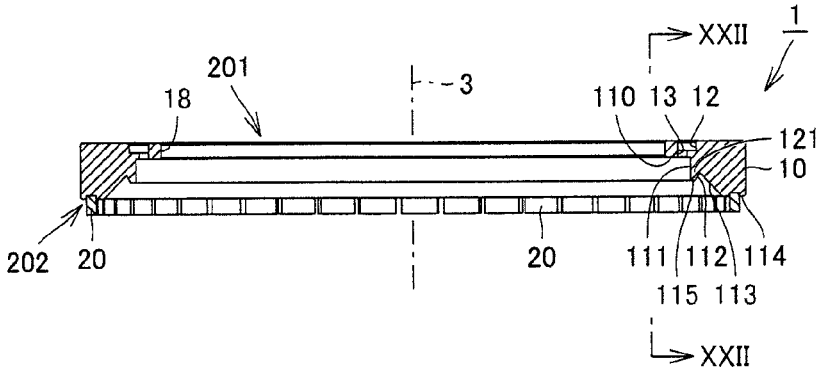
FIG. 20 is a cross-sectional view of the super abrasive wheel taken along a line XX-XX in FIG. 19.
Figure 21:
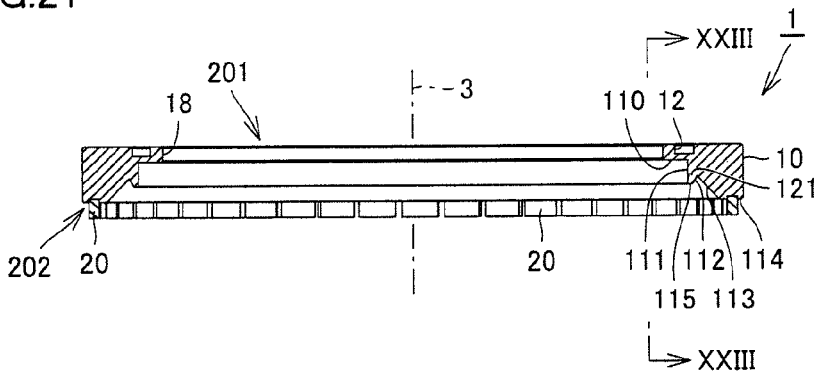
FIG. 21 is a cross-sectional view taken along a line XXI-XXI in FIG. 19.
Figure 22:
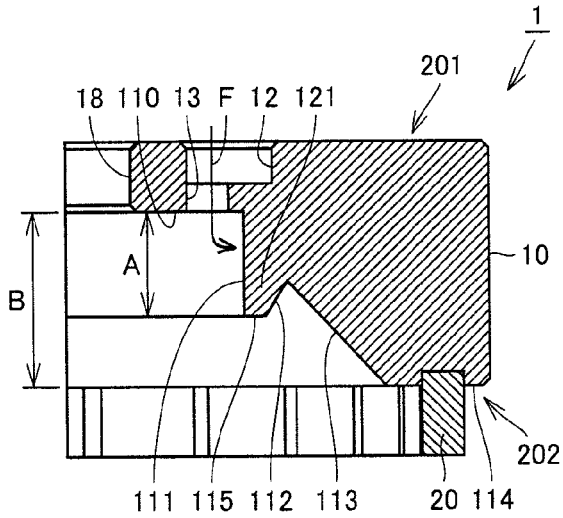
FIG. 22 is an enlarged cross-sectional view of the super abrasive wheel showing a portion surrounded by a line XXII-XXII in FIG. 20.
Figure 23:
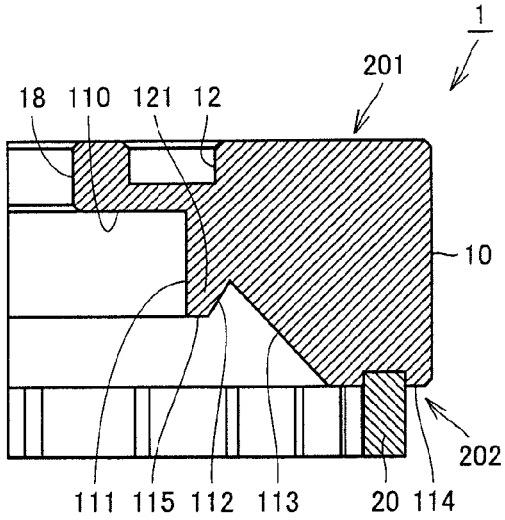
FIG. 23 is an enlarged cross-sectional view showing a portion surrounded by a line XXIII-XXIII in FIG. 21.
Figure 24:
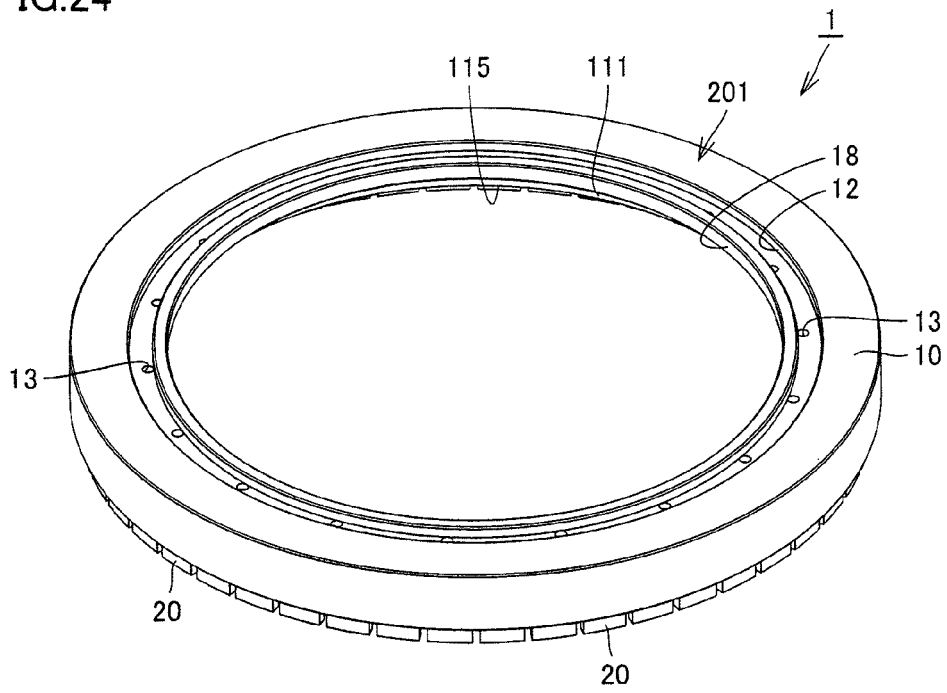
FIG. 24 is a perspective view according to an aspect of the super abrasive wheel according to the fifth embodiment of the invention.
Figure 25:
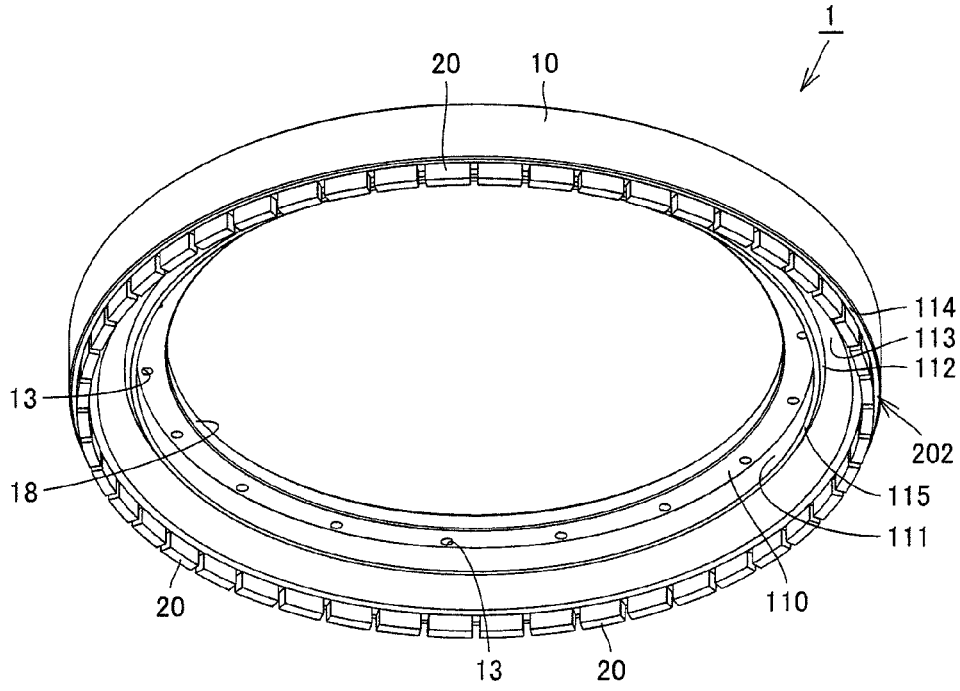
FIG. 25 is a perspective view according another aspect of the super abrasive wheel according to the fifth embodiment of the invention.

FIG. 19 is a bottom view of the super abrasive wheel according to a fifth embodiment of the invention. FIG. 20 is a cross-sectional view of the super abrasive wheel taken along a line XX-XX in FIG. 19. FIG. 21 is a cross-sectional view taken along a line XXI-XXI in FIG. 19. FIG. 22 is an enlarged cross-sectional view of the super abrasive wheel showing a portion surrounded by a line XXII-XXII in FIG. 20. FIG. 23 is an enlarged cross-sectional view showing a portion surrounded by a line XXIII-XXIII in FIG. 21. FIG. 24 is a perspective view according to an aspect of the super abrasive wheel according to the fifth embodiment of the invention. FIG. 25 is a perspective view according another aspect of the super abrasive wheel according to the fifth embodiment of the invention.

Referring to these drawings, super abrasive wheel 1 according to the fifth embodiment differs from super abrasive wheel 1 according to the first embodiment in that end portion 115 forms a flat surface. More specifically, end portion 115 has a pointed shape in super abrasive wheel 1 according to the first embodiment. By contrast, super abrasive wheel 1 according to the fifth embodiment differs from super abrasive wheel 1 according to the first embodiment in that end portion 115 has a flat shape and has a width in the radial direction.

Super abrasive wheel 1 according to the fifth embodiment configured in this manner also achieves the similar effect as super abrasive wheel 1 according to the first embodiment.

Sixth Embodiment

Figure 26:
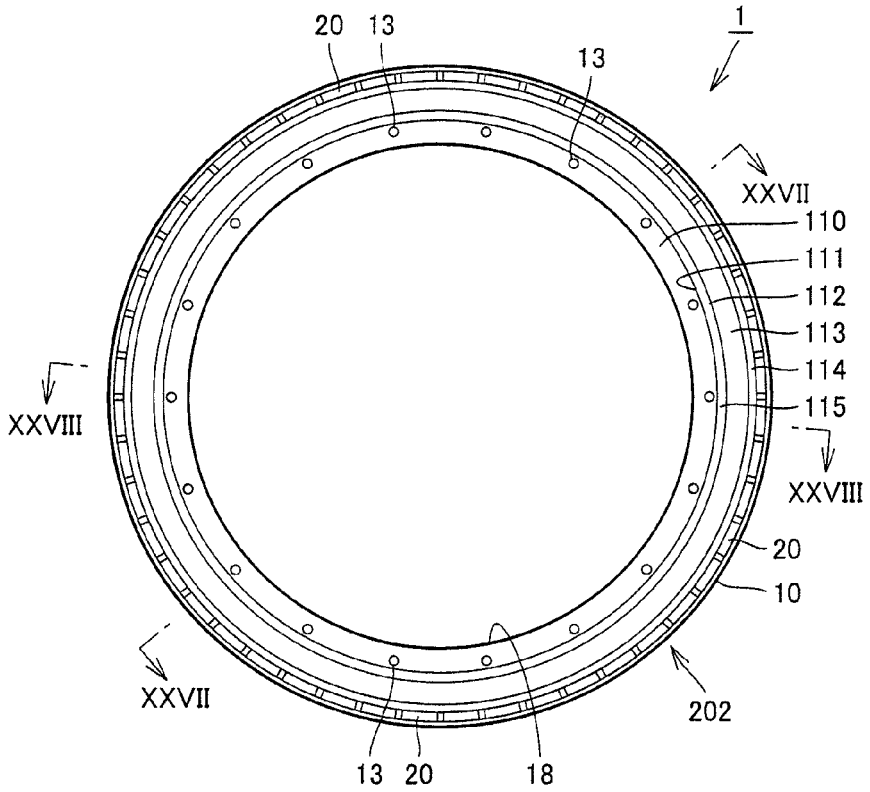
FIG. 26 is a bottom view of the super abrasive wheel according to a sixth embodiment of the invention.
Figure 27:
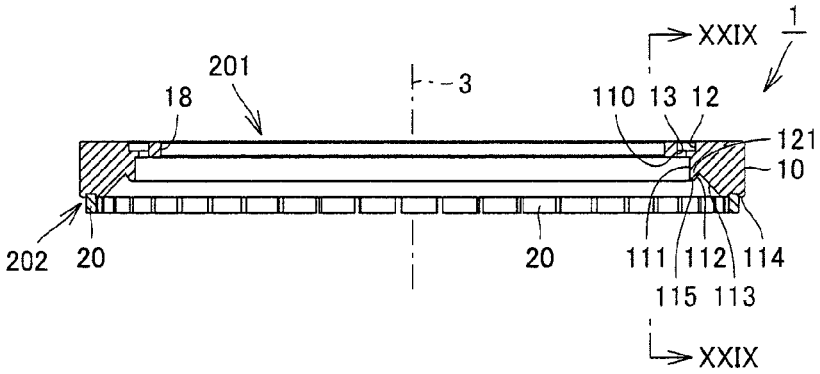
FIG. 27 is a cross-sectional view taken along a line XXVII-XXVII in FIG. 26.
Figure 28:
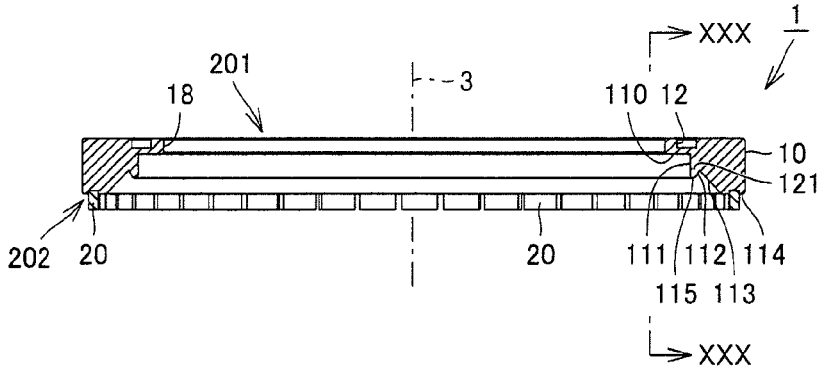
FIG. 28 is a cross-sectional view taken along a line XXVIII-XXVIII in FIG. 26.
Figure 29:
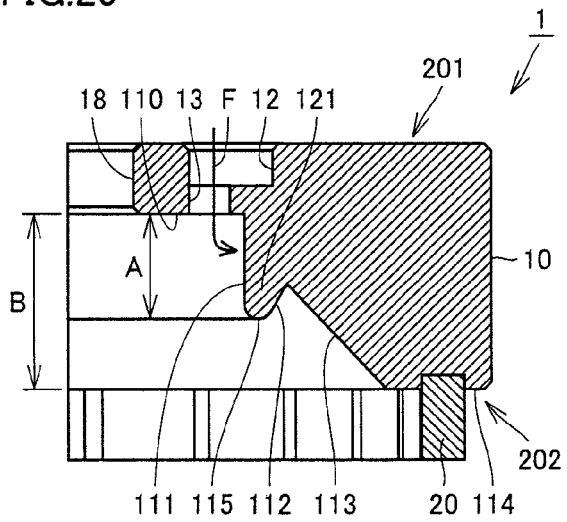
FIG. 29 is an enlarged cross-sectional view showing a portion surrounded by a line XXIX-XXIX in FIG. 27.
Figure 30:
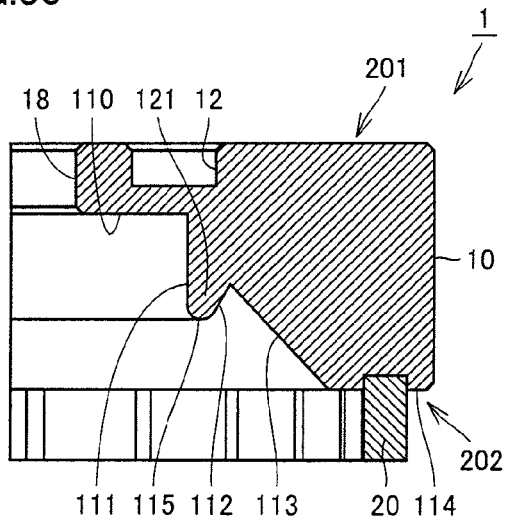
FIG. 30 is an enlarged cross-sectional view showing a portion surrounded by a line XXX-XXX in FIG. 28.
Figure 31:
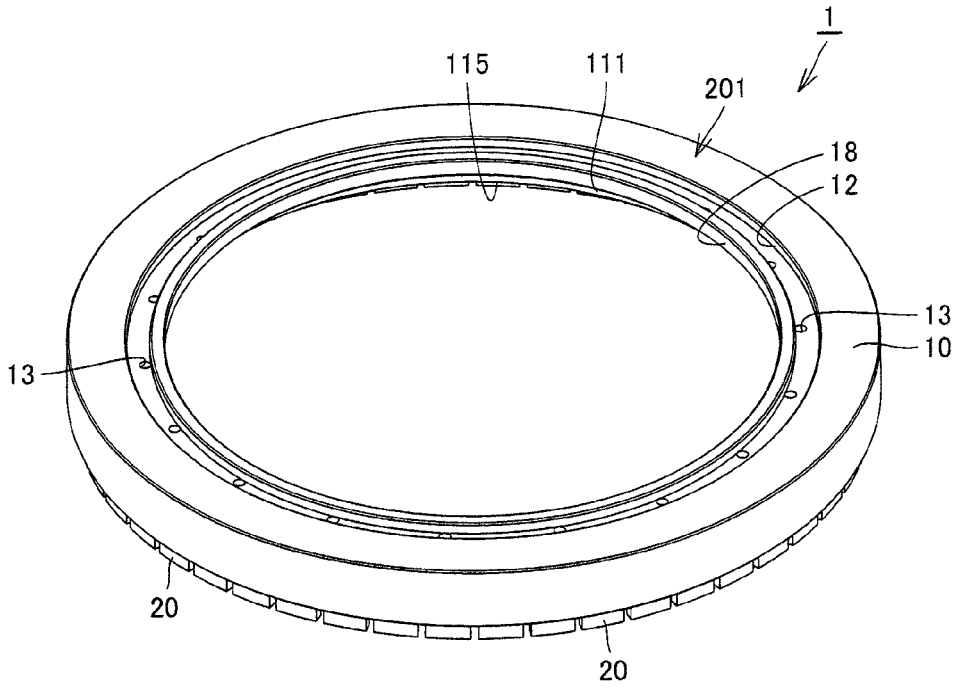
FIG. 31 is a perspective view according to an aspect of the super abrasive wheel according to the sixth embodiment of the invention.
Figure 32:
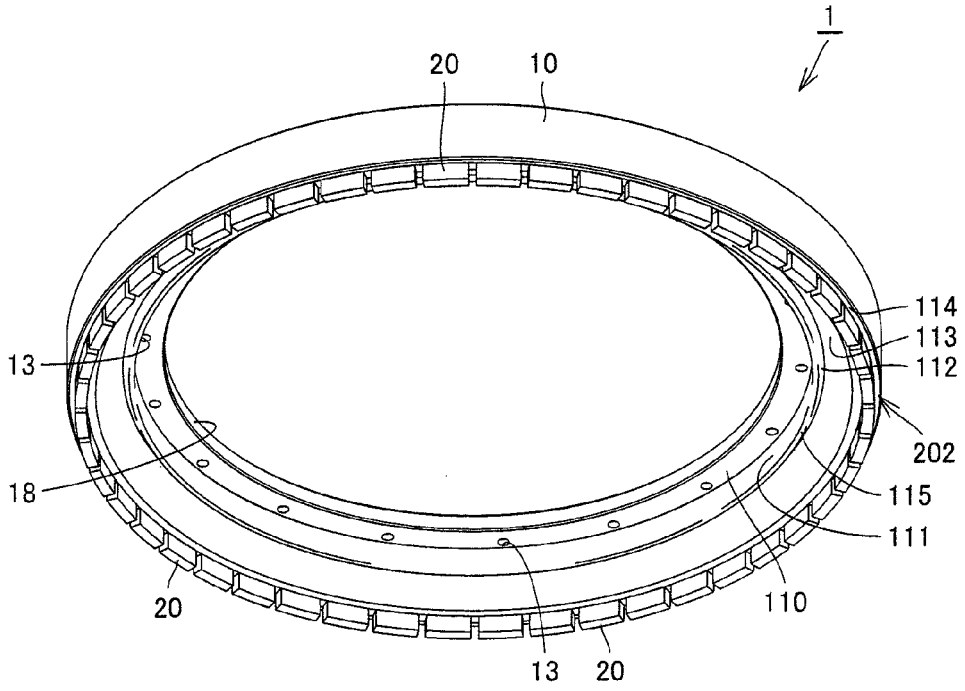
FIG. 32 is a perspective view according to another aspect of the super abrasive wheel according to the sixth embodiment of the invention.

FIG. 26 is a bottom view of the super abrasive wheel according to a sixth embodiment of the invention. FIG. 27 is a cross-sectional view taken along a line XXVII-XXVII in FIG. 26. FIG. 28 is a cross-sectional view taken along a line XXVIII-XXVIII in FIG. 26. FIG. 29 is an enlarged cross-sectional view of the super abrasive wheel showing a portion surrounded by a line XXIX-XXIX in FIG. 27. FIG. 30 is an enlarged cross-sectional view of the super abrasive wheel showing a portion surrounded by a line XXX-XXX in FIG. 28. FIG. 31 is a perspective view according to an aspect of the super abrasive wheel according to the sixth embodiment of the invention. FIG. 32 is a perspective view according to another aspect of the super abrasive wheel according to the sixth embodiment of the invention.

Referring to these drawings, the super abrasive wheel according to the sixth embodiment differs from the super abrasive wheel according to other embodiments in that end portion 115 has an arc shape in cross section. The radius of the arc of the arc-shaped end portion 115 is not specifically limited. The radius is not necessarily constant, and a plurality of curvatures may be combined.

Seventh Embodiment

Figure 33:
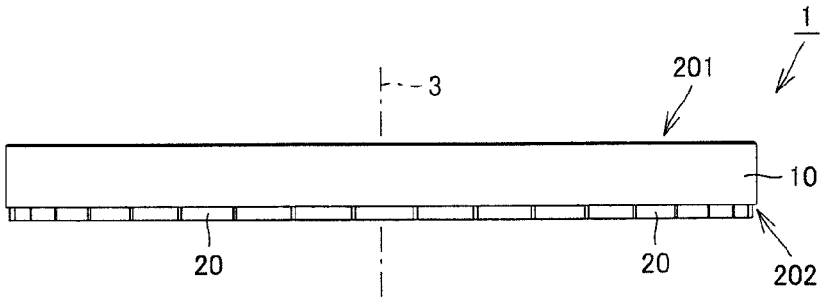
FIG. 33 is a front view of the super abrasive wheel according to a seventh embodiment of the invention.
Figure 34:
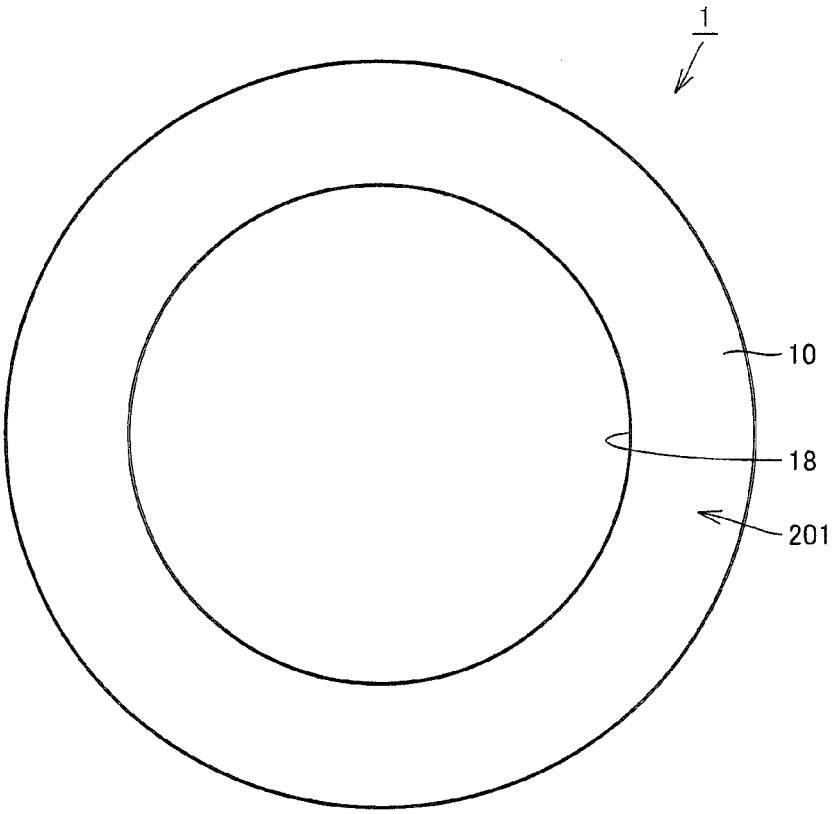
FIG. 34 is a plan view of the super abrasive wheel according to the seventh embodiment of the invention.
Figure 35:
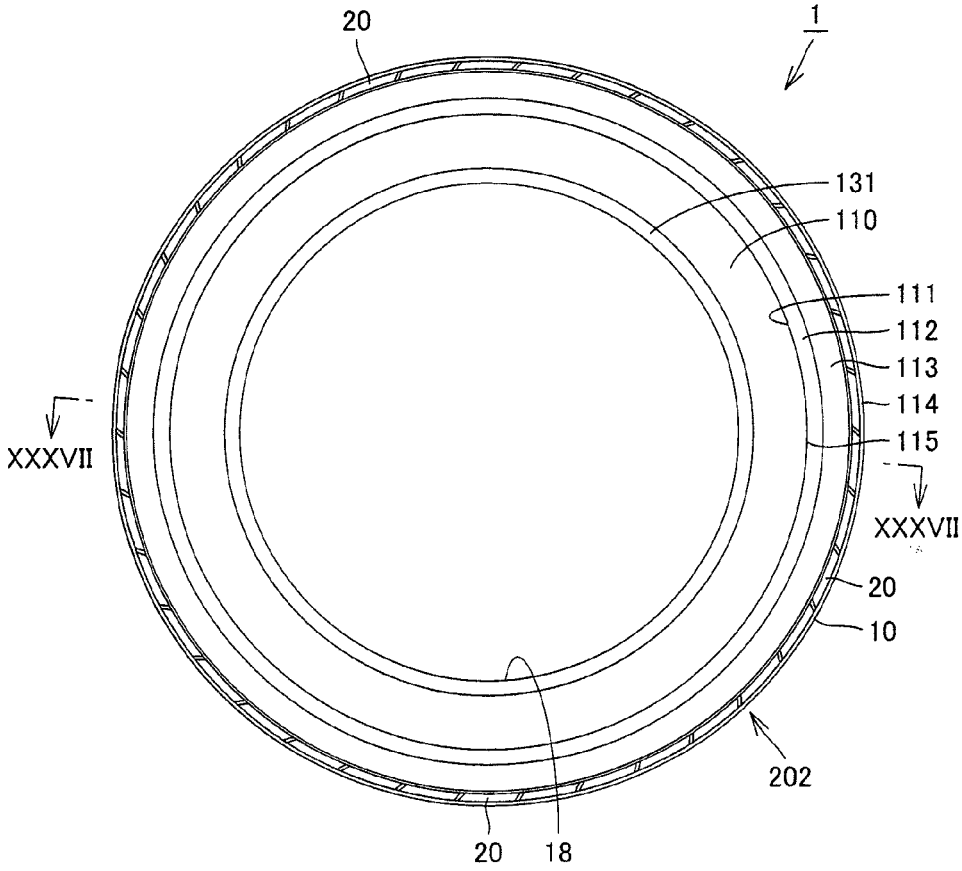
FIG. 35 is a bottom view of the super abrasive wheel according to the seventh embodiment of the invention.
Figure 36:
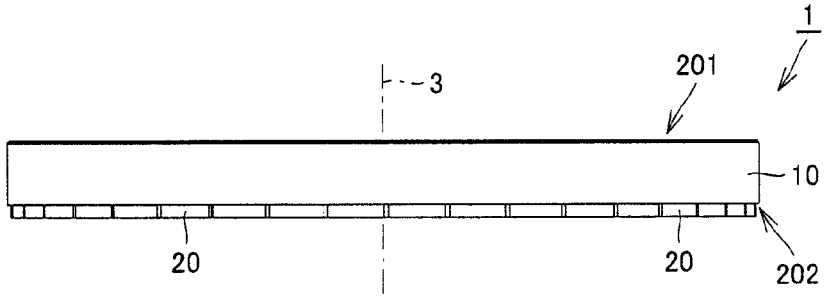
FIG. 36 is a right side view of the super abrasive wheel according to the seventh embodiment of the invention.
Figure 37:
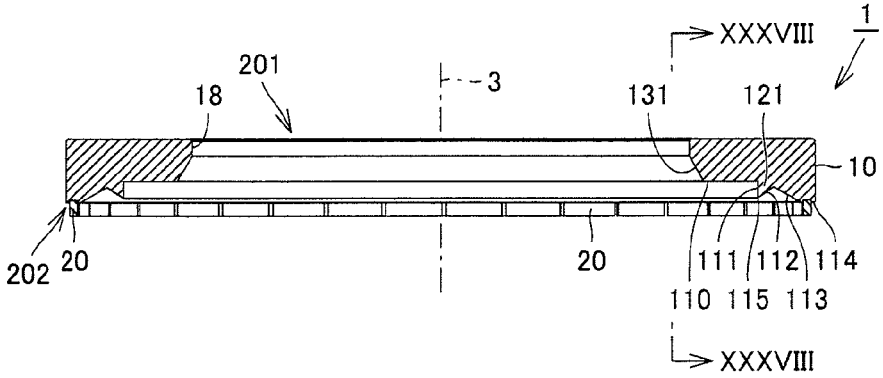
FIG. 37 is a cross-sectional view taken along a line XXXVII-XXXVII in FIG. 35.
Figure 38:
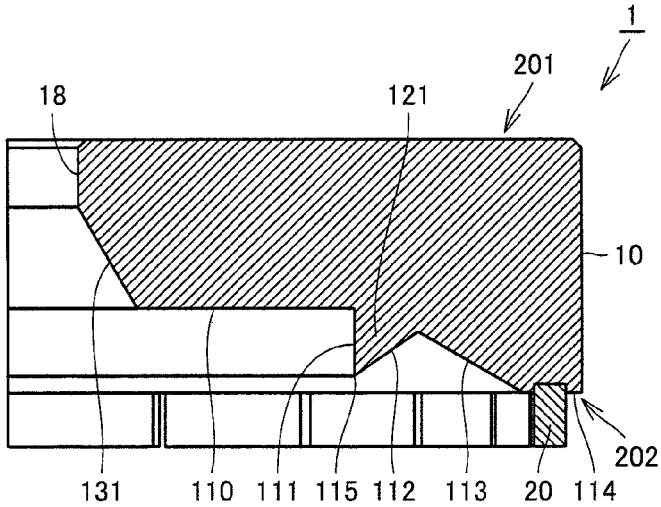
FIG. 38 is an enlarged cross-sectional view showing a portion surrounded by a line XXXVIII-XXXVIII in FIG. 37.
Figure 39:
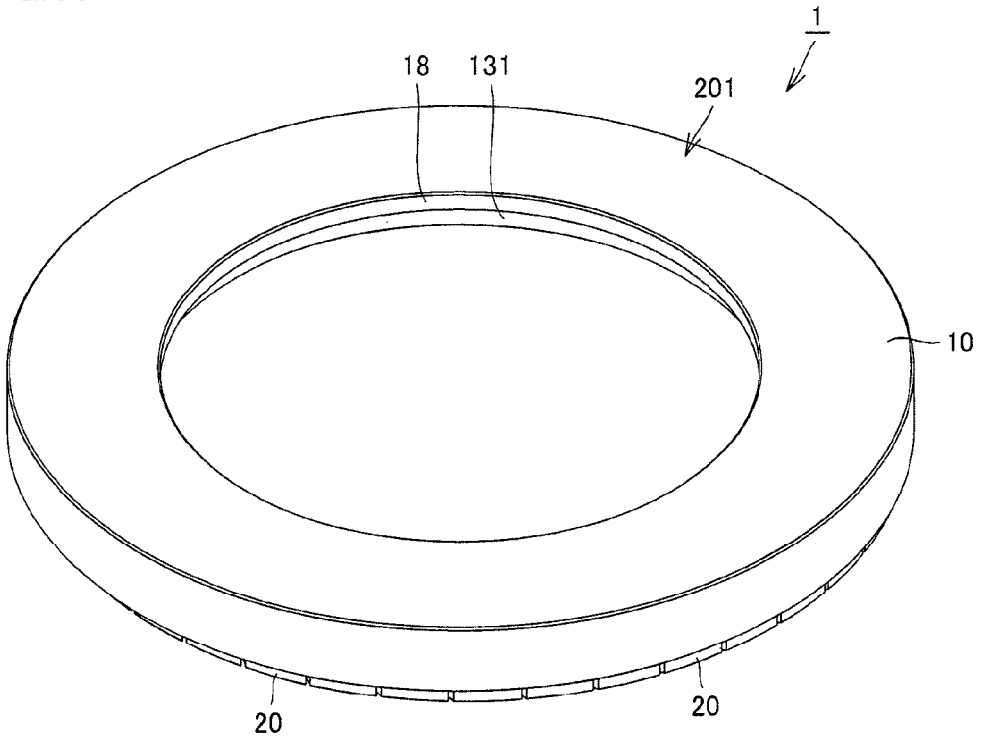
FIG. 39 is a perspective view according to an aspect of the super abrasive wheel according to the seventh embodiment of the invention.
Figure 40:
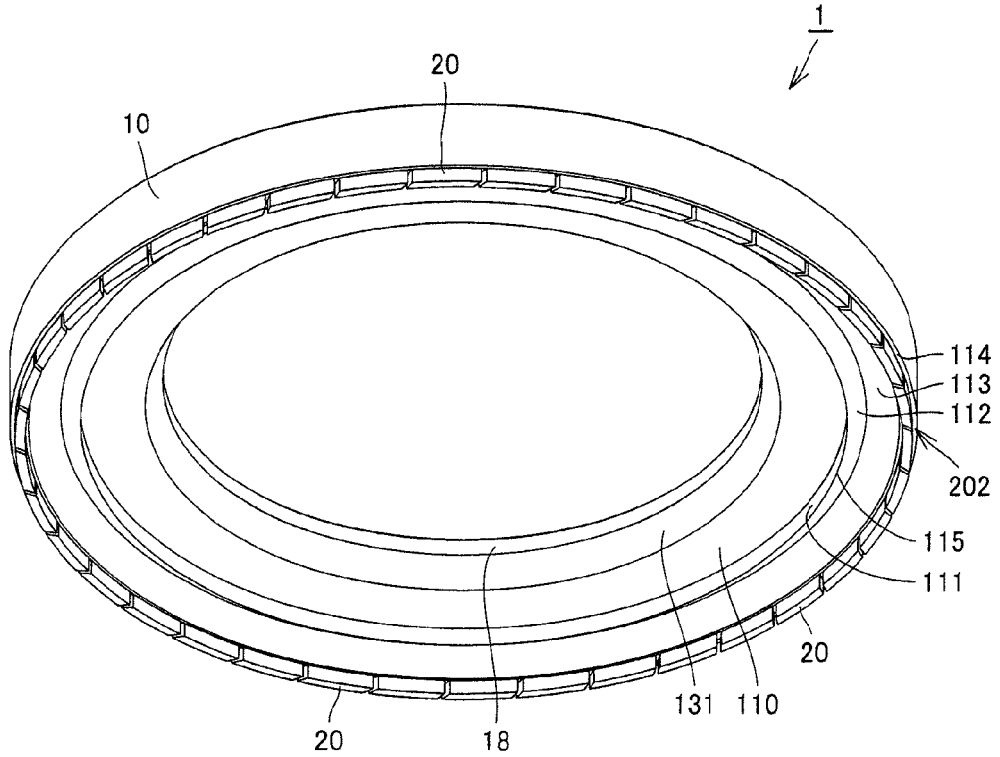
FIG. 40 is a perspective view according to another aspect of the super abrasive wheel according to the seventh embodiment of the invention.

FIG. 33 is a front view of the super abrasive wheel according to a seventh embodiment of the invention. FIG. 34 is a plan view of the super abrasive wheel according to the seventh embodiment of the invention. FIG. 35 is a bottom view of the super abrasive wheel according to the seventh embodiment of the invention. FIG. 36 is a right side view of the super abrasive wheel according to the seventh embodiment of the invention. FIG. 37 is a cross-sectional view taken along a line XXXVII-XXXVII in FIG. 35. FIG. 38 is an enlarged cross-sectional view showing a portion surrounded by XXXVIII-XXXVIII in FIG. 37. FIG. 39 is a perspective view according to an aspect of the super abrasive wheel according to the seventh embodiment of the invention. FIG. 40 is a perspective view according to another aspect of the super abrasive wheel according to the seventh embodiment of the invention.

Referring to these drawings, the super abrasive wheel according to the seventh embodiment differs from the super abrasive wheel according to the first embodiment in that grinding fluid supply holes are not provided in core 10. In place of provision of a hole for supplying grinding fluid in the super abrasive wheel, a nozzle is used to supply grinding fluid from the inner circumferential side of super abrasive wheel 1. An inner circumferential taper surface 131 is provided on the outside of inner circumferential wall 18. Reference surface 110, first rising wall 111, first inverted taper surface 112, outer taper surface 113, and top portion 114 are arranged so as to be continuous from inner circumferential taper surface 131.

Figure 41:
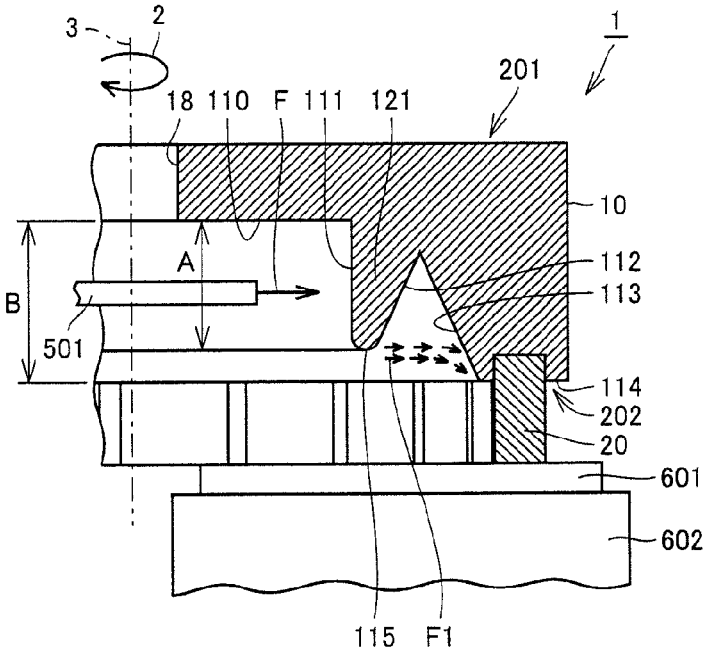
FIG. 41 is a diagram for explaining a grinding process in the super abrasive wheel according to the seventh embodiment of the invention.

FIG. 41 is a diagram for explaining a grinding process in the super abrasive wheel according to the seventh embodiment. Referring to FIG. 41, a wafer 601 is held by a rotary table 602 of a grinder. The grinding fluid supplied in the direction shown by arrow F from a nozzle 501 has its flow rate, pressure, and direction controlled such that the grinding fluid directly reaches first rising wall 111 of the annular first protrusion portion 121 with a rotational speed of super abrasive wheel 1 during working. The flow of the grinding fluid may be skewed by centrifugal force of rotation so that the grinding fluid directly reaches first rising wall 111. The grinding fluid in abutment with first rising wall 111 is diffused and emitted from end portion 115 in the direction shown by an arrow F1. As a result, the grinding fluid is supplied uniformly to the contact interface between super abrasive layer 20 and wafer 601 as a workpiece, thereby preventing burning of a product to be ground (workpiece) and bringing about the effect of stably keeping a sharp edge for a long time. The grinding fluid made into finer particles is supplied to super abrasive layer 20 at a reduced speed due to collision against outer taper surface 113. In other words, a method of manufacturing a wafer according to the present invention is to grind wager 601 using super abrasive wheel 1 as described above.

Eighth Embodiment

Figure 42:
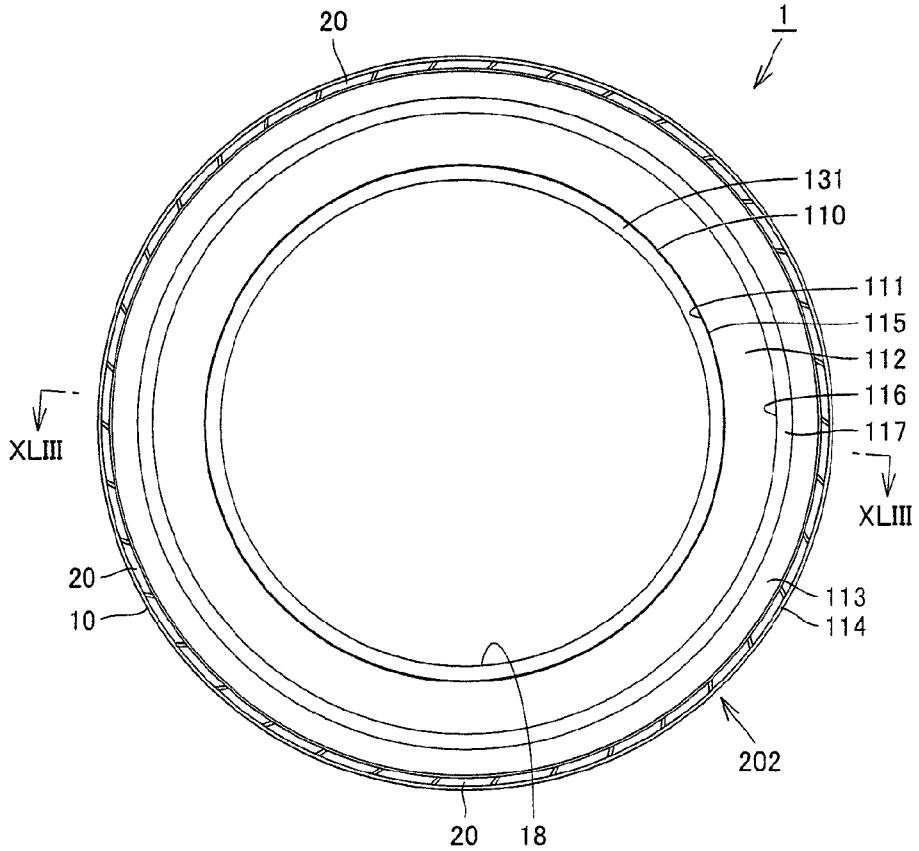
FIG. 42 is a bottom view of the super abrasive wheel according to an eighth embodiment of the invention.
Figure 43:
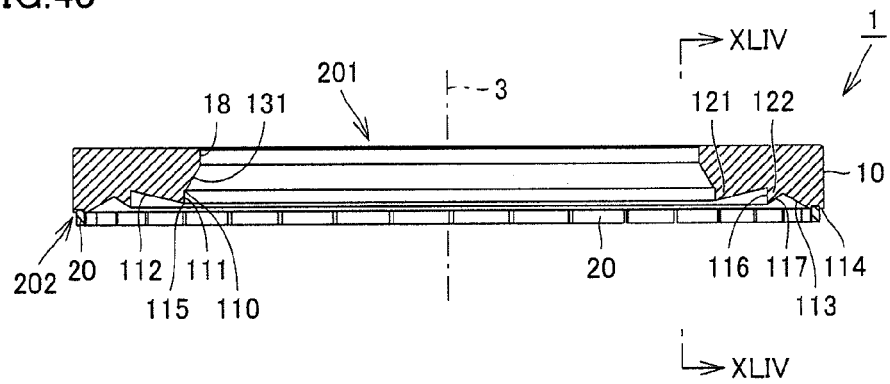
FIG. 43 is a cross-sectional view taken along a line XLIII-XLIII in FIG. 42.
Figure 44:
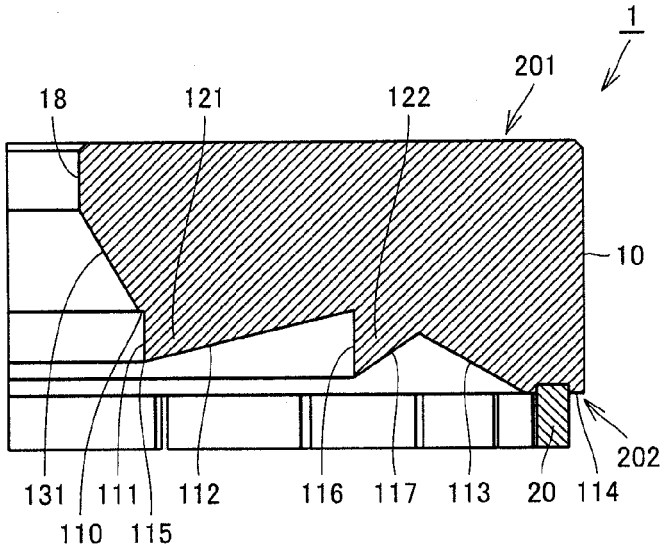
FIG. 44 is an enlarged cross-sectional view showing a portion surrounded by a line XLIV-XLIV in FIG. 43.
Figure 45:
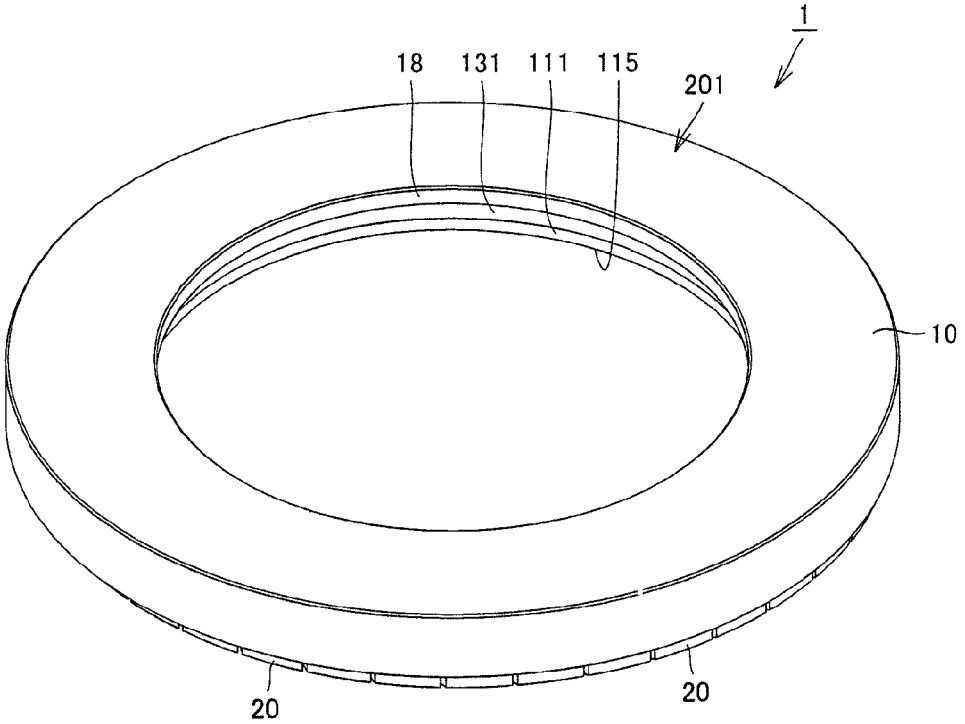
FIG. 45 is a perspective view according to an aspect of the super abrasive wheel according to the eighth embodiment of the invention.
Figure 46:
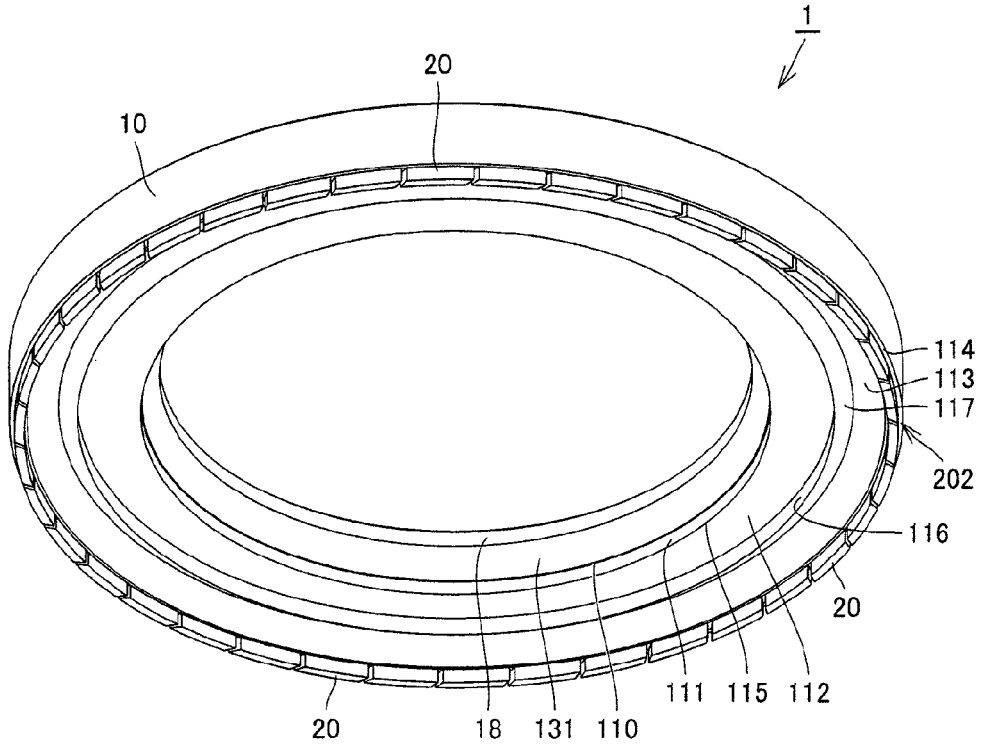
FIG. 46 is a perspective view according to another aspect of the super abrasive wheel according to the eighth embodiment of the invention.

FIG. 42 is a bottom view of the super abrasive wheel according to an eighth embodiment of the invention. FIG. 43 is a cross-sectional view taken along a line XLIII-XLIII in FIG. 42. FIG. 44 is an enlarged cross-sectional view showing a portion surrounded by a line XLIV-XLIV in FIG. 43. FIG. 45 is a perspective view according to an aspect of the super abrasive wheel according to the eighth embodiment of the invention. FIG. 46 is a perspective view according to another aspect of the super abrasive wheel according to the eighth embodiment of the invention.

The super abrasive wheel 1 according to the eighth embodiment of the invention differs from the super abrasive wheel 1 according to the seventh embodiment in that first protrusion portion 121 and second protrusion portion 122 are provided. More additional protrusion portions may be provided.

Ninth Embodiment

Figure 47:
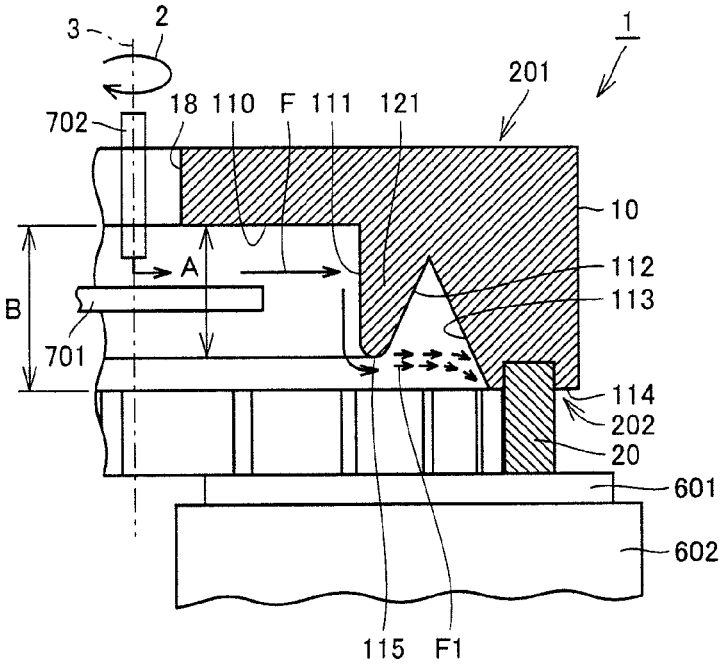
FIG. 47 is a diagram for explaining a grinding process in the super abrasive wheel according to a ninth embodiment of the invention.

FIG. 47 is a diagram for explaining a grinding process in the super abrasive wheel according to a ninth embodiment of the invention. Referring to FIG. 47, a baffle 701 may be used to diffuse grinding fluid. Specifically, grinding fluid is supplied from a nozzle 702 along the axial direction. The grinding fluid flows radially along baffle 701 and is discharged radially outward as shown by arrow F to collide against first rising wall 111. Then, after passing through end portion 115, the grinding fluid diffuses in the direction shown by arrow F1 and collides against outer taper surface 113. The grinding fluid is thereafter supplied to the interface between super abrasive layer 20 and wafer 601.

Tenth Embodiment

Figure 48:
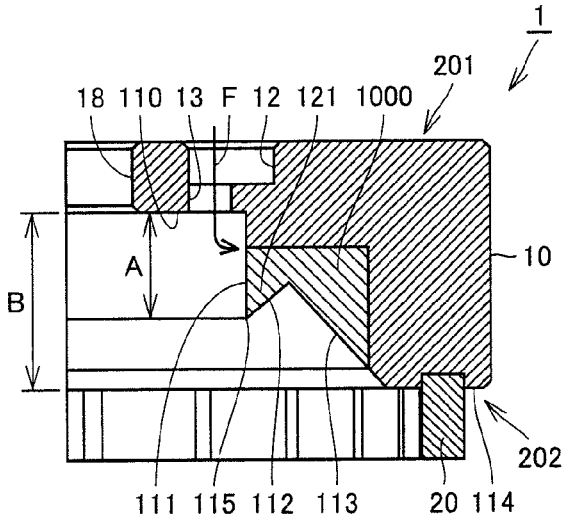
FIG. 48 is a cross-sectional view of the super abrasive wheel according to a tenth embodiment of the invention.

FIG. 48 is a cross-sectional view of the super abrasive wheel according to a tenth embodiment of the invention. Referring to FIG. 48, in super abrasive wheel 1 according to the tenth embodiment, a protrusion member 1000 separate from core 10 is attached to core 10. Protrusion member 1000 has first protrusion portion 121. Protrusion member 1000 is attached to a surface closer to super abrasive layer 20 away from reference surface 110. Protrusion member 1000 is removably attached to core 10, for example, with a fastening member such as a bolt. Super abrasive wheel 1 according to the tenth embodiment includes core 10 rotating around rotation axis 3 and super abrasive layer 20 bonded to the core. Core 10 has first surface 201 and second surface 202 located opposite to first surface 201. Protrusion member 1000 is provided at a portion of second surface 202 that is surrounded with super abrasive layer 20. Protrusion member 1000 has the annular first protrusion portion 121 which protrudes in the direction away from first surface 201. Reference surface 110 is provided at a portion of second surface 202 on the inside of first protrusion portion 121. The height from reference surface 110 to the first protrusion portion is denoted as A. Top portion 114 having height B from reference surface 110 is provided at a portion of second surface 202 between first protrusion portion 121 and super abrasive layer 20. Height B is greater than height A.

The shape of the working surface of super abrasive layer 20 may be any one of an approximate rectangle, an approximate parallelogram, and an approximate trapezoid. The corner portions of the working surface of super abrasive layer 20 may be rounded.

Eleventh Embodiment

Figure 49:
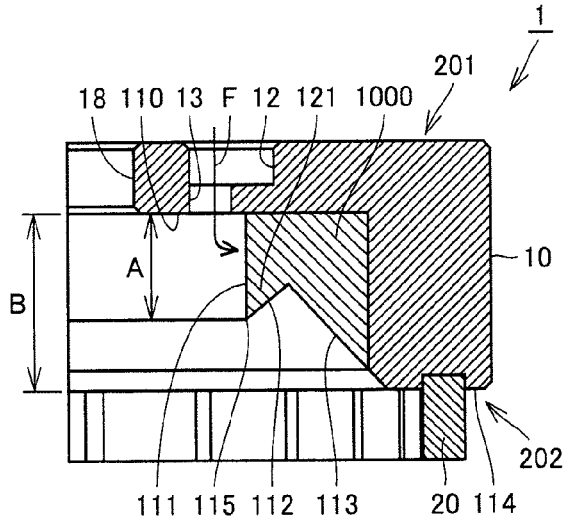
FIG. 49 is a cross-sectional view of the super abrasive wheel according to an eleventh embodiment of the invention.

FIG. 49 is a cross-sectional view of the super abrasive wheel according to an eleventh embodiment of the invention. Referring to FIG. 49, in super abrasive wheel 1 according to the eleventh embodiment of the invention, the surface on which protrusion member 1000 is attached is flush with reference surface 110.

Twelfth Embodiment

Figure 50:
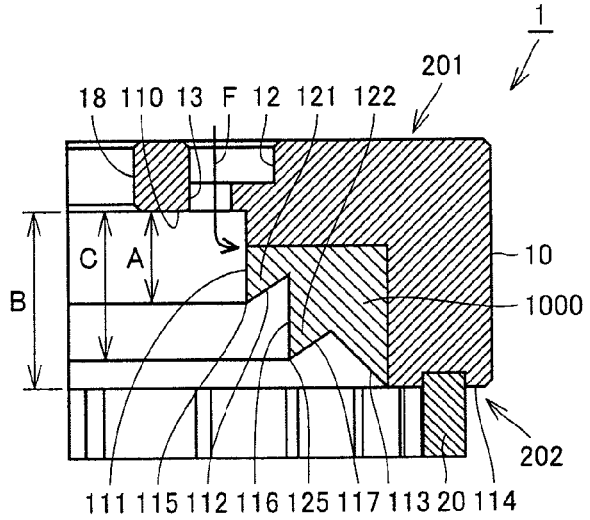
FIG. 50 is a cross-sectional view of the super abrasive wheel according to a twelfth embodiment of the invention.

FIG. 50 is a cross-sectional view of the super abrasive wheel according to a twelfth embodiment of the invention. Referring to FIG. 50, protrusion member 1000 according to the twelfth embodiment of the invention has first protrusion portion 121 and second protrusion portion 122. Protrusion member 1000 is provided on a surface closer to super abrasive layer 20 away from reference surface 110. As for the size, A<C<B holds.

Thirteenth Embodiment

Figure 51:
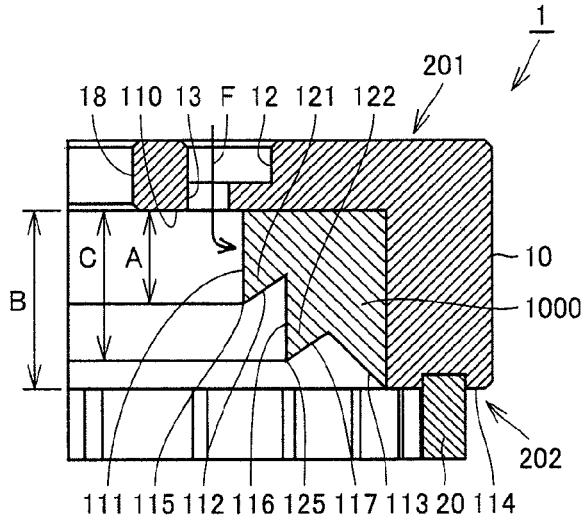
FIG. 51 is a cross-sectional view of the super abrasive wheel according to a thirteenth embodiment of the invention.

FIG. 51 is a cross-sectional view of the super abrasive wheel according to a thirteenth embodiment of the invention. Referring to FIG. 51, in super abrasive wheel 1 according to the thirteenth embodiment, the surface on which protrusion member 1000 is attached is flush with reference surface 110.

Fourteenth Embodiment

Figure 52:
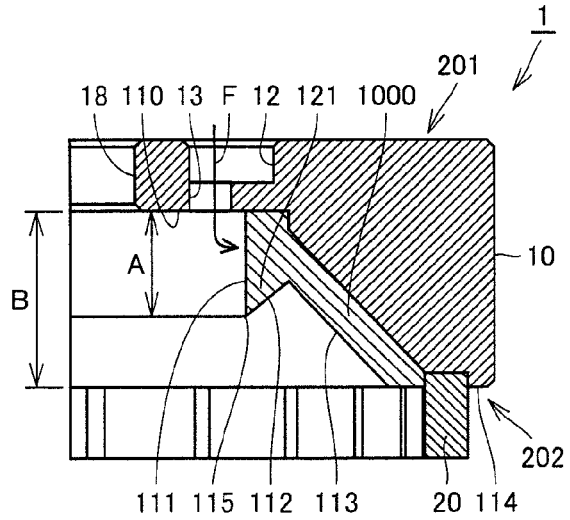
FIG. 52 is a cross-sectional view of the super abrasive wheel according to a fourteenth embodiment of the invention.

FIG. 52 is a cross-sectional view of the super abrasive wheel according to a fourteenth embodiment of the invention. Referring to FIG. 52, in super abrasive wheel 1 according to the fourteenth embodiment of the invention, part of the boundary between protrusion member 1000 and core 10 is an inclined surface. Part of the boundary between protrusion member 1000 and core 10 is reference surface 110.

Fifteenth Embodiment

Figure 53:
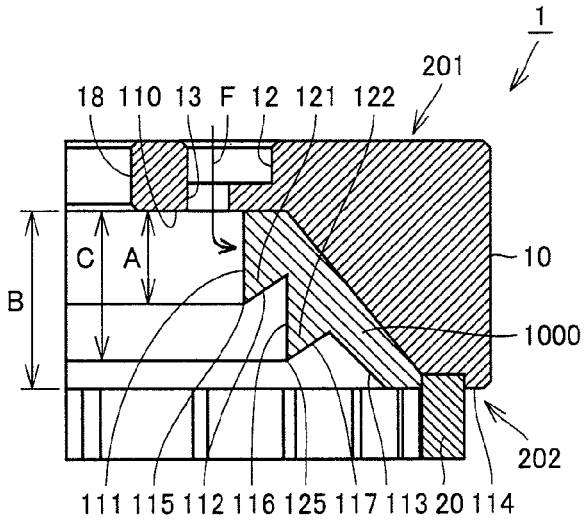
FIG. 53 is a cross-sectional view of the super abrasive wheel according to a fifteenth embodiment of the invention.

FIG. 53 is a cross-sectional view of the super abrasive wheel according to a fifteenth embodiment of the invention. Referring to FIG. 53, in super abrasive wheel 1 according to the fifteenth embodiment of the invention, the boundary between protrusion member 1000 and core 10 is an inclined surface. Part of the boundary between protrusion member 1000 and core 10 is on reference surface 110.

Sixteenth Embodiment

Figure 54:
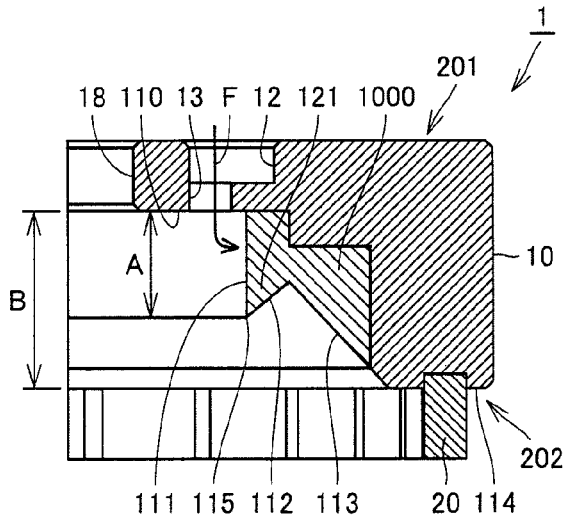
FIG. 54 is a cross-sectional view of the super abrasive wheel according to a sixteenth embodiment of the invention.

FIG. 54 is a cross-sectional view of the super abrasive wheel according to a sixteenth embodiment of the invention. Referring to FIG. 54, in super abrasive wheel 1 according to the sixteenth embodiment, the boundary surface between protrusion member 1000 and core 10 is stepwise.

Seventeenth Embodiment

Figure 55:
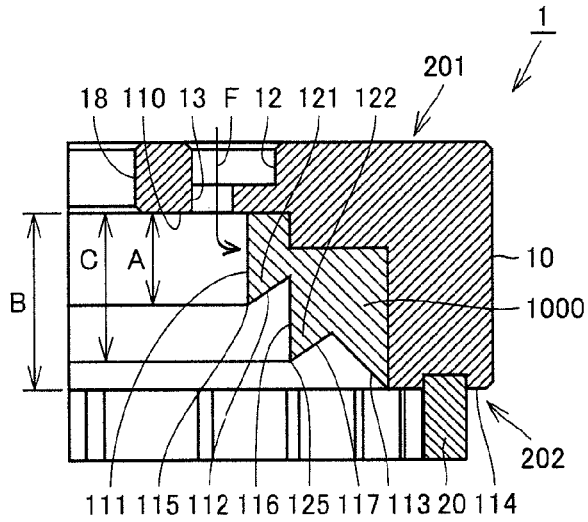
FIG. 55 is a cross-sectional view of the super abrasive wheel according to a seventeenth embodiment of the invention.

FIG. 55 is a cross-sectional view of the super abrasive wheel according to a seventeenth embodiment of the invention. Referring to FIG. 55, in super abrasive wheel 1 according to the seventeenth embodiment of the invention, the boundary surface between protrusion member 1000 and core 10 is stepwise.

Eighteenth Embodiment

Figure 56:
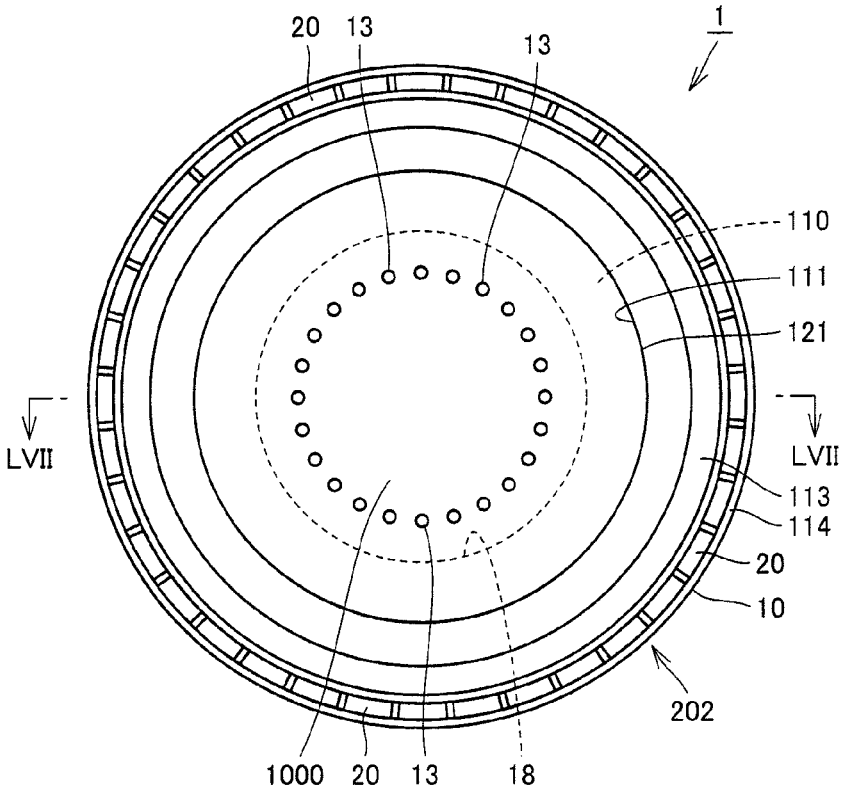
FIG. 56 is a bottom view of the super abrasive wheel according to an eighteenth embodiment of the invention.
Figure 57:
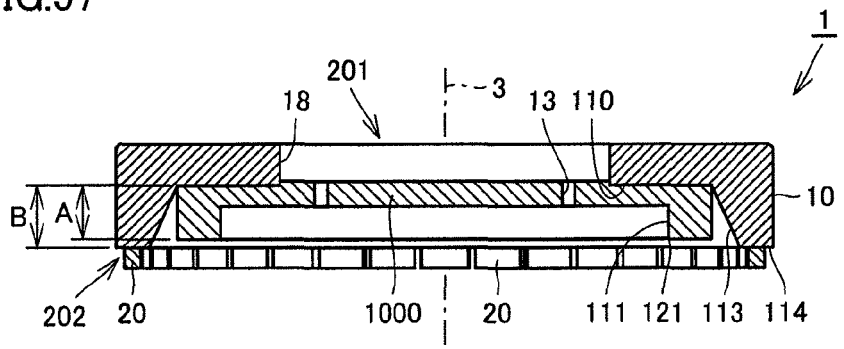
FIG. 57 is a cross-sectional view taken along an arrow LVII-LVII in FIG. 56.

FIG. 56 is a bottom view of the super abrasive wheel according to an eighteenth embodiment of the invention. FIG. 57 is a cross-sectional view taken along an arrow LVII-LVII in FIG. 56. Referring to FIG. 56 and FIG. 57, in super abrasive wheel 1 according to the eighteenth embodiment, protrusion member 1000 is attached on reference surface 110 of core 10. Protrusion member 1000 is formed like a cover and has grinding fluid supply holes 13 in a center region thereof. Grinding fluid is supplied from grinding fluid supply holes 13. The supplied grinding fluid is scattered in the outer circumferential direction by centrifugal force and reaches first rising wall 111. The grinding fluid, passing through first rising wall 111, diffuses from first protrusion portion 121 to be supplied to super abrasive layer 20. The supplied grinding fluid is supplied to the contact interface between super abrasive layer 20 and the workpiece to lubricate and cool the contact interface.

Nineteenth Embodiment

Figure 58:
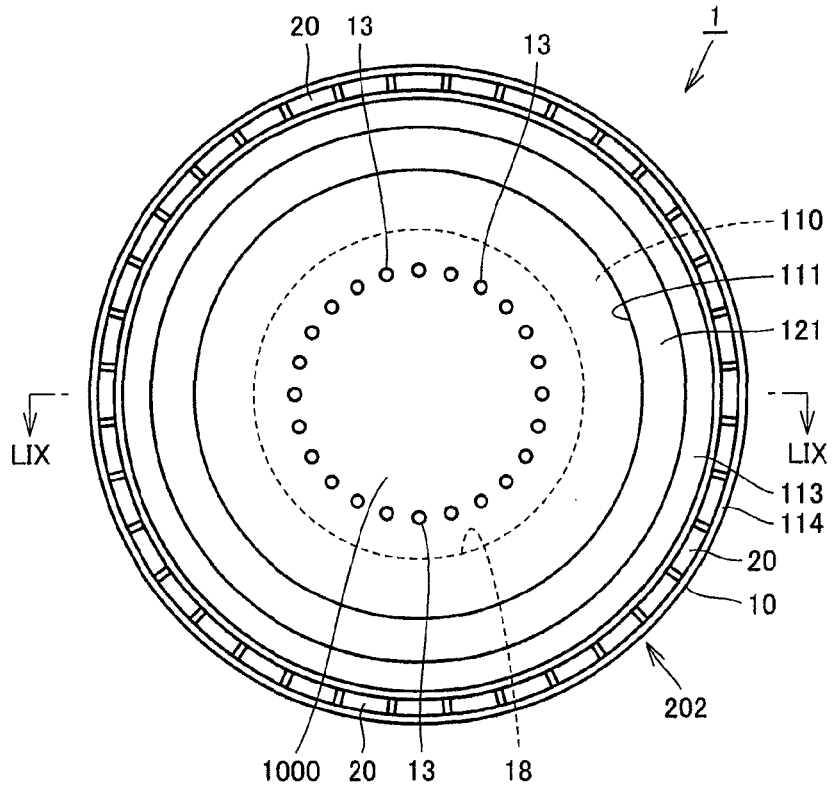
FIG. 58 is a bottom view of the super abrasive wheel according to a nineteenth embodiment of the invention.
Figure 59:
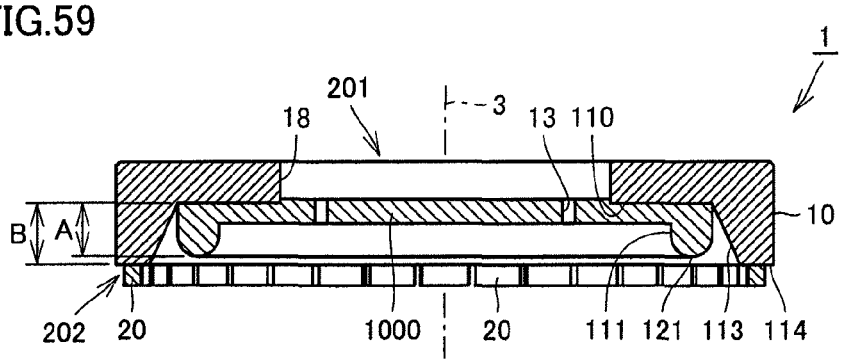
FIG. 59 is a cross-sectional view taken along a line LIX-LIX in FIG. 58.

FIG. 58 is a bottom view of the super abrasive wheel according to a nineteenth embodiment of the invention. FIG. 59 is a cross-sectional view taken along a line LIX-LIX in FIG. 58. Referring to FIG. 58 and FIG. 59, in super abrasive wheel 1 according to the nineteenth embodiment, first protrusion portion 121 at the tip end of protrusion member 1000 is arc-shaped. Although in the present embodiment first protrusion portion 121 at the tip end of protrusion member 1000 is arc-shaped by way of example, the tip ends of first protrusion portion 121 and second protrusion portion 122 provided integrally with core 10 may be arc-shaped.

Twelfth Embodiment

Figure 60:
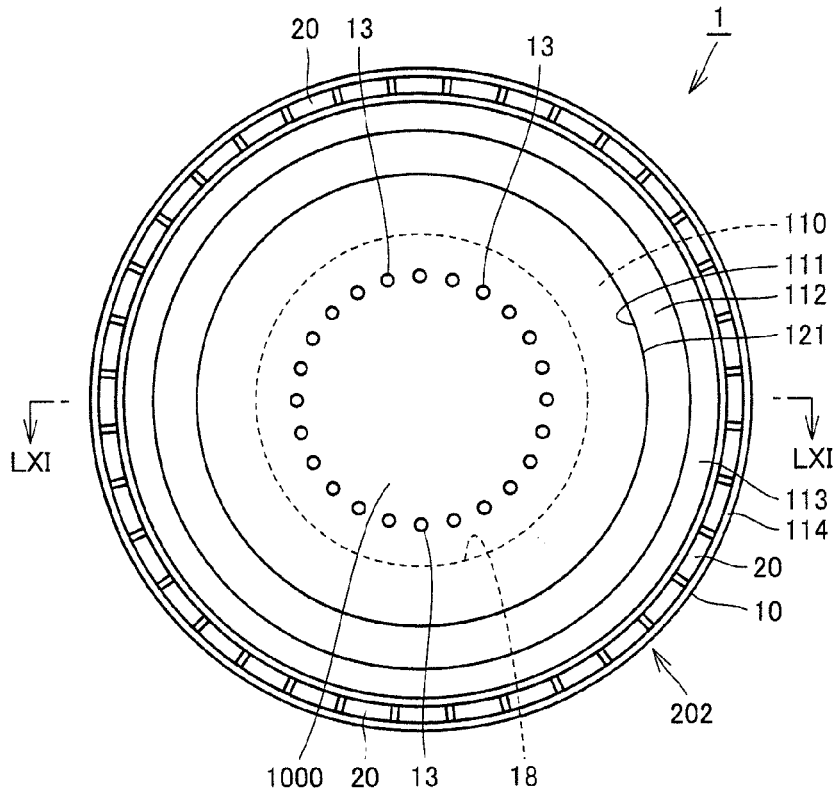
FIG. 60 is a bottom view of the super abrasive wheel according to a twentieth embodiment of the invention.
Figure 61:
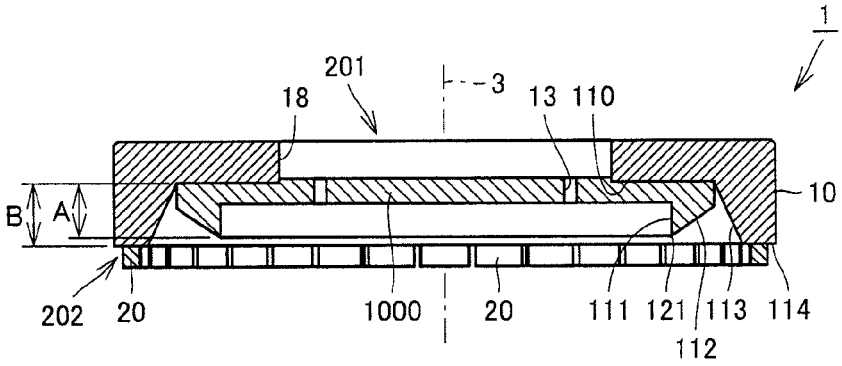
FIG. 61 is a cross-sectional view taken along a line LXI-LXI in FIG. 60.

FIG. 60 is a bottom view of the super abrasive wheel according to a twentieth embodiment of the invention. FIG. 61 is a cross-sectional view taken along a line LXI-LXI in FIG. 60. Referring to FIG. 60 and FIG. 61, in super abrasive wheel 1 according to the twelfth embodiment, first inverted taper surface 112 is provided on the outer circumferential side of first protrusion portion 121.

Twenty-first Embodiment

Figure 62:
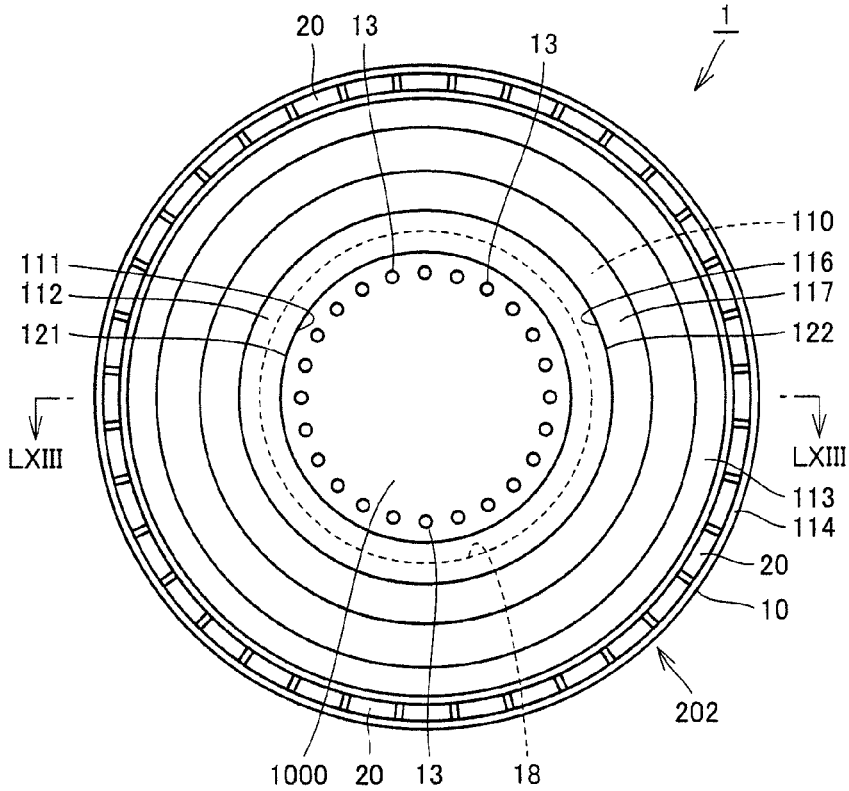
FIG. 62 is a bottom view of the super abrasive wheel according to a twenty-first embodiment of the invention.
Figure 63:
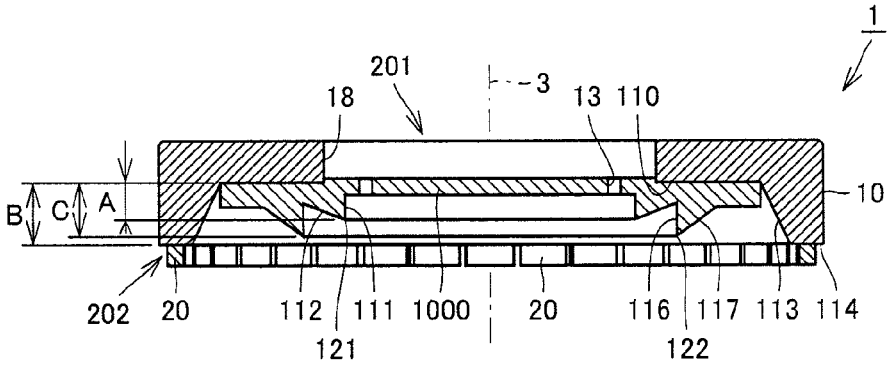
FIG. 63 is a cross-sectional view taken along a line LXIII-LXIII in FIG. 62.

FIG. 62 is a bottom view of the super abrasive wheel according to a twenty-first embodiment of the invention. FIG. 63 is a cross-sectional view taken along a line LXIII-LXIII in FIG. 62. Referring to FIG. 62 and FIG. 63, in super abrasive wheel 1 according to the twenty-first embodiment, protrusion member 1000 has first protrusion portion 121, first inverted taper surface 112, second protrusion portion 122, and second inverted taper surface 117.

Twenty-second Embodiment

Figure 64:
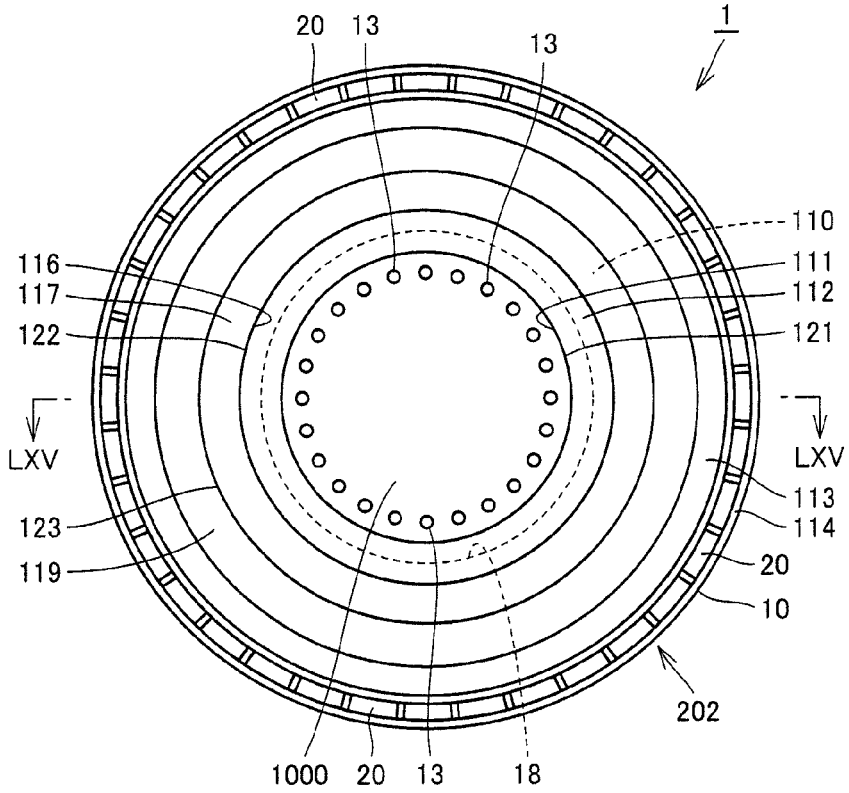
FIG. 64 is a bottom view of the super abrasive wheel according to a twenty-second embodiment of the invention.
Figure 65:
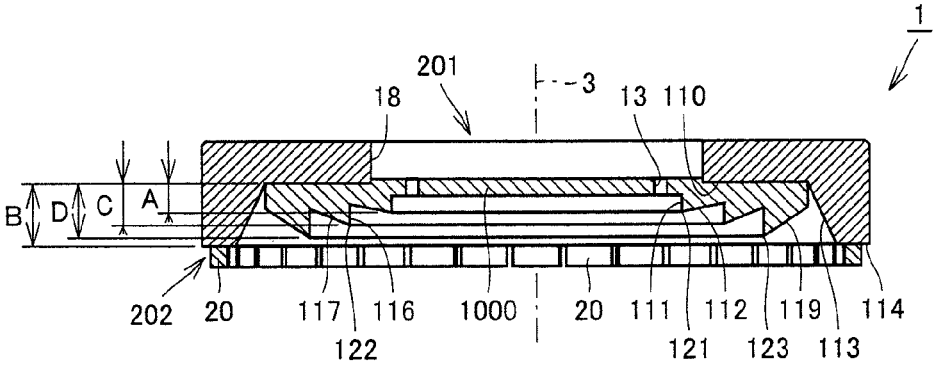
FIG. 65 is a cross-sectional view taken along a line LXV-LXV in FIG. 64.

FIG. 64 is a bottom view of the super abrasive wheel according to a twenty-second embodiment of the invention. FIG. 65 is a cross-sectional view taken along a line LXV-LXV in FIG. 64. Referring to FIG. 64 and FIG. 65, in super abrasive wheel 1 according to the twenty-second embodiment, protrusion member 1000 has first protrusion portion 121, first inverted taper surface 112, second protrusion portion 122, second inverted taper surface 117, a third protrusion portion 123, and a third inverted taper surface 119. As for the size, $A<C<D<B$ holds.

Twenty-third Embodiment

Figure 66:
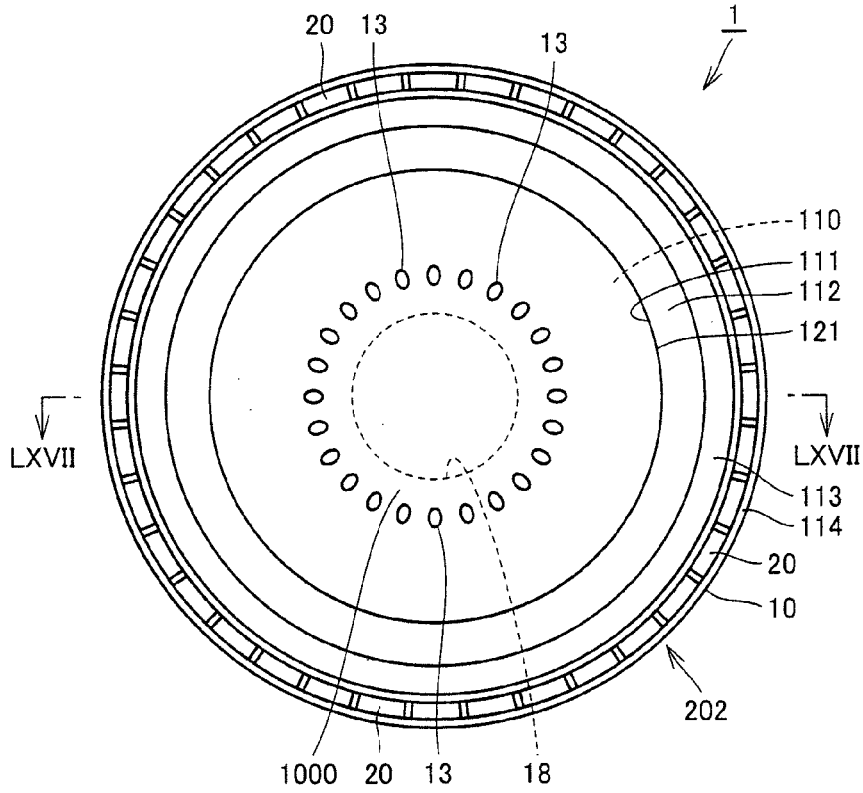
FIG. 66 is a bottom view of the super abrasive wheel according to a twenty-third embodiment of the invention.
Figure 67:
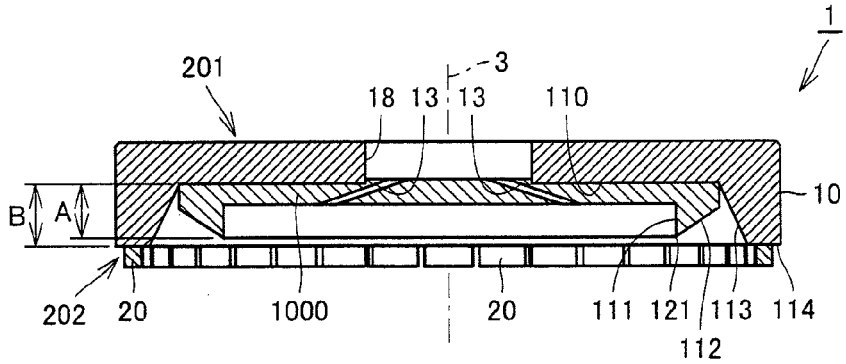
FIG. 67 is a cross-sectional view taken along a line LXVII-LXVII in FIG. 66.

FIG. 66 is a bottom view of the super abrasive wheel according to a twenty-third embodiment of the invention. FIG. 67 is a cross-sectional view taken along a line LXVII-LXVII in FIG. 66. Referring to FIG. 66 and FIG. 67, in super abrasive wheel 1 according to the twenty-third embodiment, grinding fluid supply hole 13 penetrates through protrusion member 1000 so as to extend toward the outer circumference.

Twenty-fourth Embodiment

Figure 68:
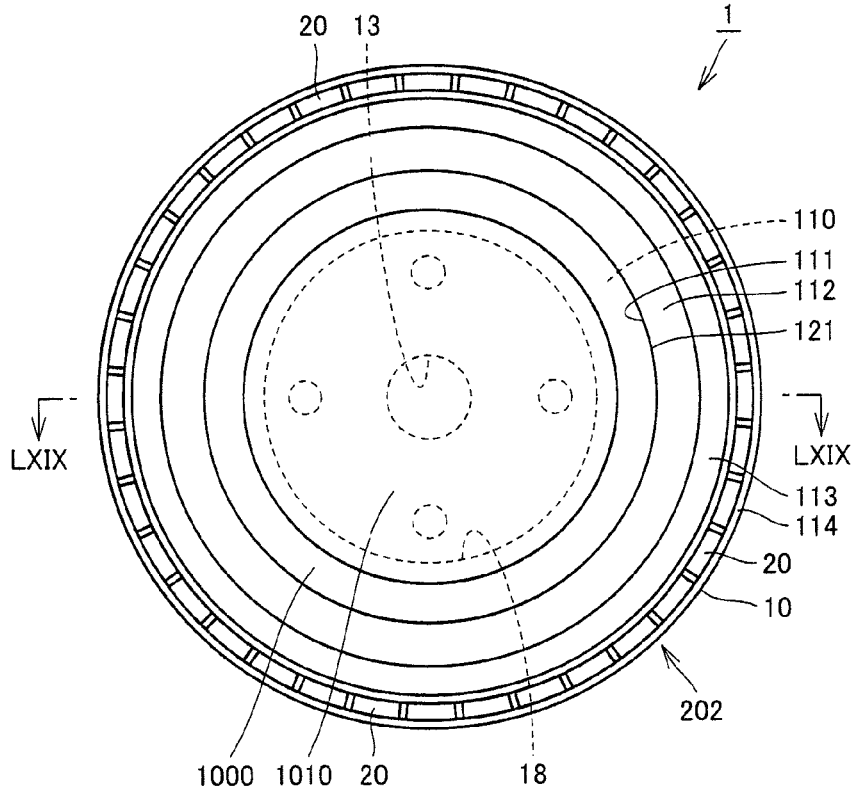
FIG. 68 is a bottom view of the super abrasive wheel according to a twenty-fourth embodiment of the invention.
Figure 69:
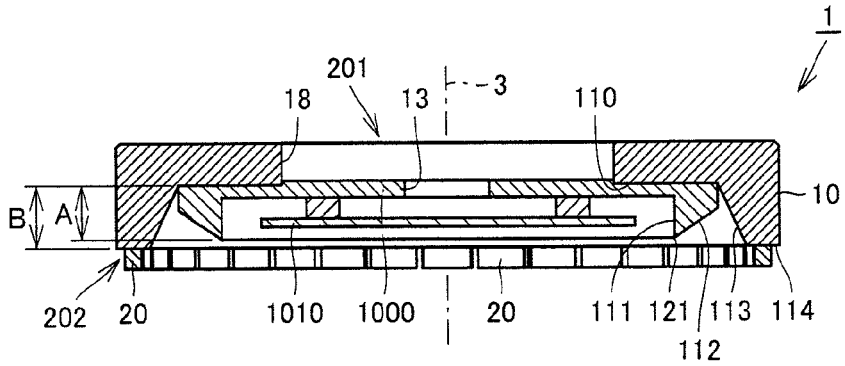
FIG. 69 is a cross-sectional view taken along a line LXIX-LXIX in FIG. 68.

FIG. 68 is a bottom view of the super abrasive wheel according to a twenty-fourth embodiment of the invention. FIG. 69 is a cross-sectional view taken along a line LXIX-LXIX in FIG. 68. Referring to FIG. 68 and FIG. 69, in super abrasive wheel 1 according to the twenty-fourth embodiment of the invention, protrusion member 1000 is provided with a baffle 1010. Baffle 1010 is provided to face grinding fluid supply hole 13. The grinding fluid supplied from grinding fluid supply hole 13 has its course changed by baffle 1010 and then moves in the outer circumferential direction. Then, the grinding fluid passes through first protrusion portion 121 and then arrives at super abrasive layer 20.

Twenty-fifth Embodiment

Figure 70:
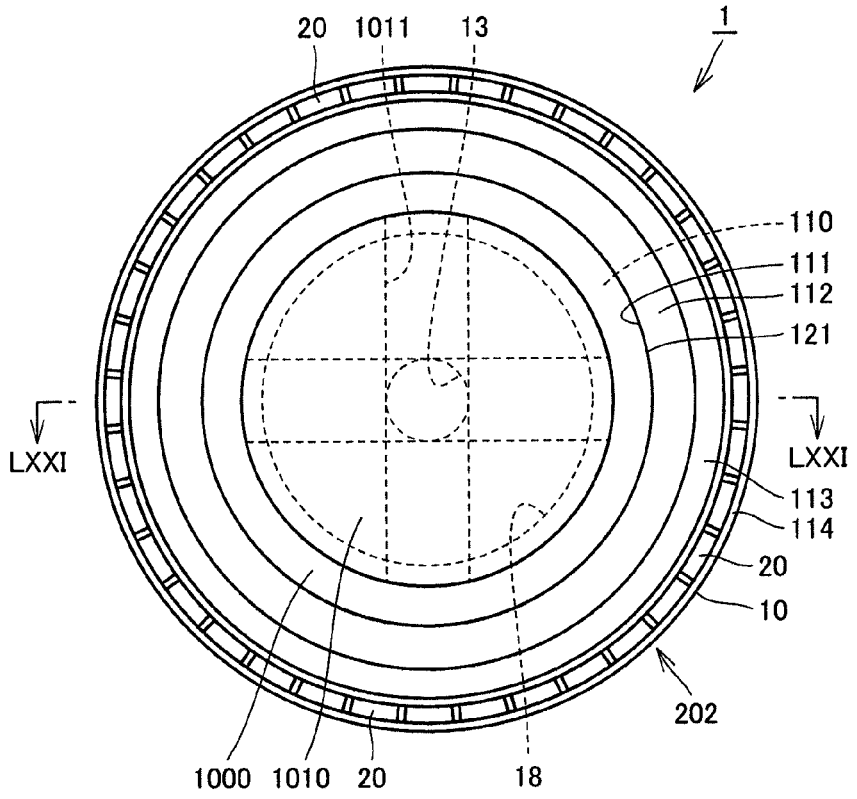
FIG. 70 is a bottom view of the super abrasive wheel according to a twenty-fifth embodiment of the invention.
Figure 71:
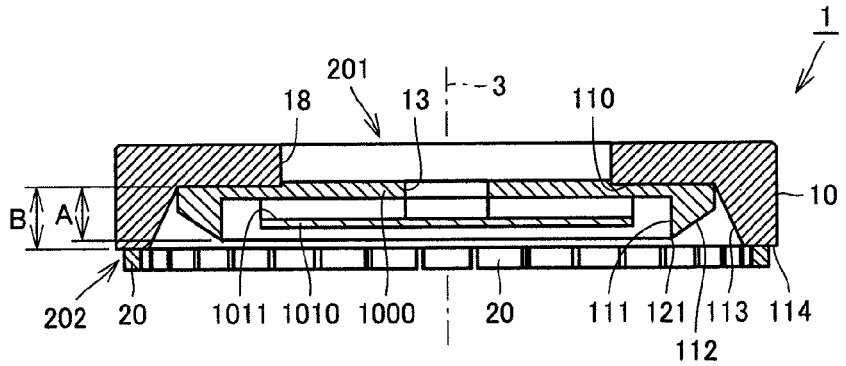
FIG. 71 is a cross-sectional view taken along a line LXXI-LXXI in FIG. 70.

FIG. 70 is a bottom view of the super abrasive wheel according to a twenty-fifth embodiment of the invention. FIG. 71 is a cross-sectional view taken along a line LXXI-LXXI in FIG. 70. Referring to FIG. 70 and FIG. 71, in super abrasive wheel 1 according to the twenty-fifth embodiment of the invention, a grinding fluid passage 1011 is provided to extend in a cross shape between baffle 1010 and protrusion member 1000. The grinding fluid supplied from grinding fluid supply hole 13 is supplied toward first protrusion portion 121 through grinding fluid passage 1011.

Twenty-sixth Embodiment

Figure 72:
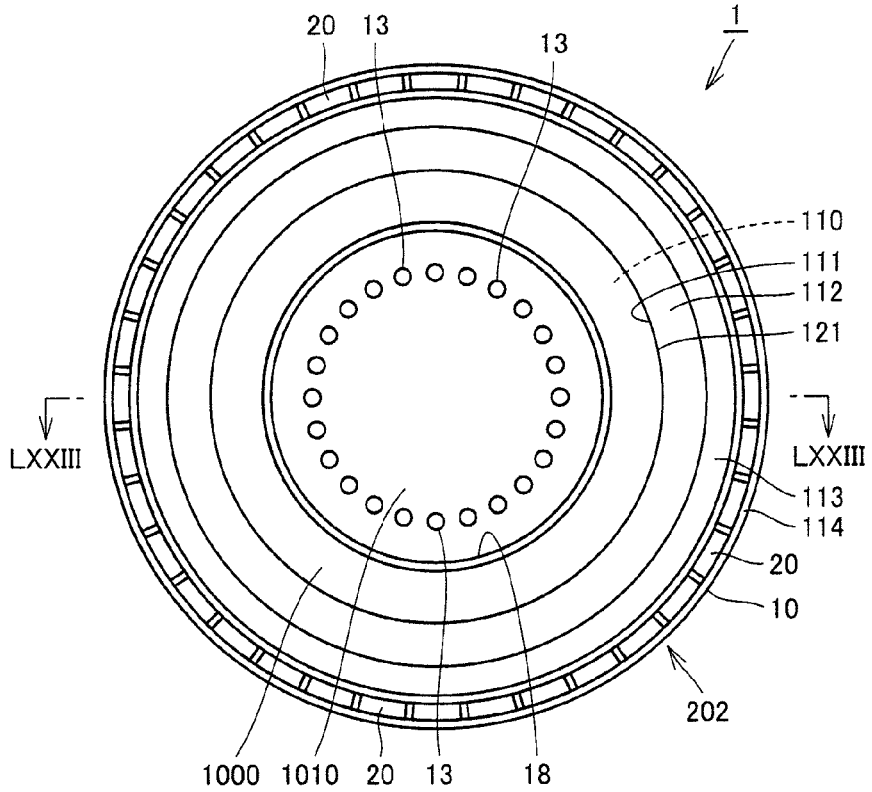
FIG. 72 is a bottom view of the super abrasive wheel according to a twenty-sixth embodiment of the invention.
Figure 73:
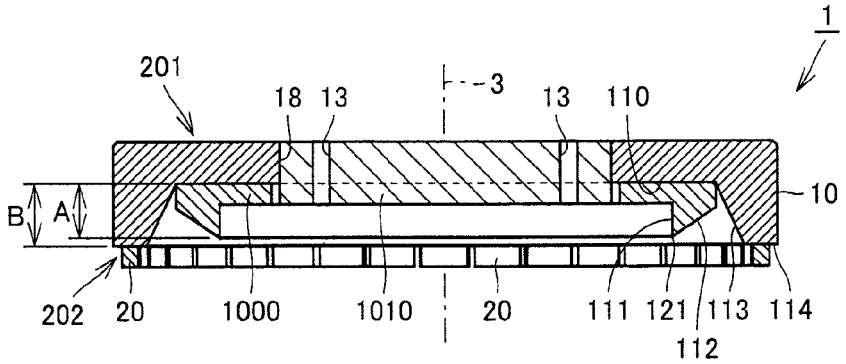
FIG. 73 is a cross-sectional view taken along a line LXXIII-LXXIII in FIG. 72.

FIG. 72 is a bottom view of the super abrasive wheel according to a twenty-sixth embodiment of the invention. FIG. 73 is a cross-sectional view taken along a line LXXIII-LXXIII in FIG. 72. Referring to FIG. 72 and FIG. 73, in super abrasive wheel 1 according to the twenty-sixth embodiment of the invention, grinding fluid supply holes 13 are provided on a machine that rotates super abrasive wheel 1. The grinding fluid supplied from grinding fluid supply holes 13 is supplied toward first protrusion portion 121 of protrusion member 1000.

Twenty-seventh Embodiment

Figure 74:
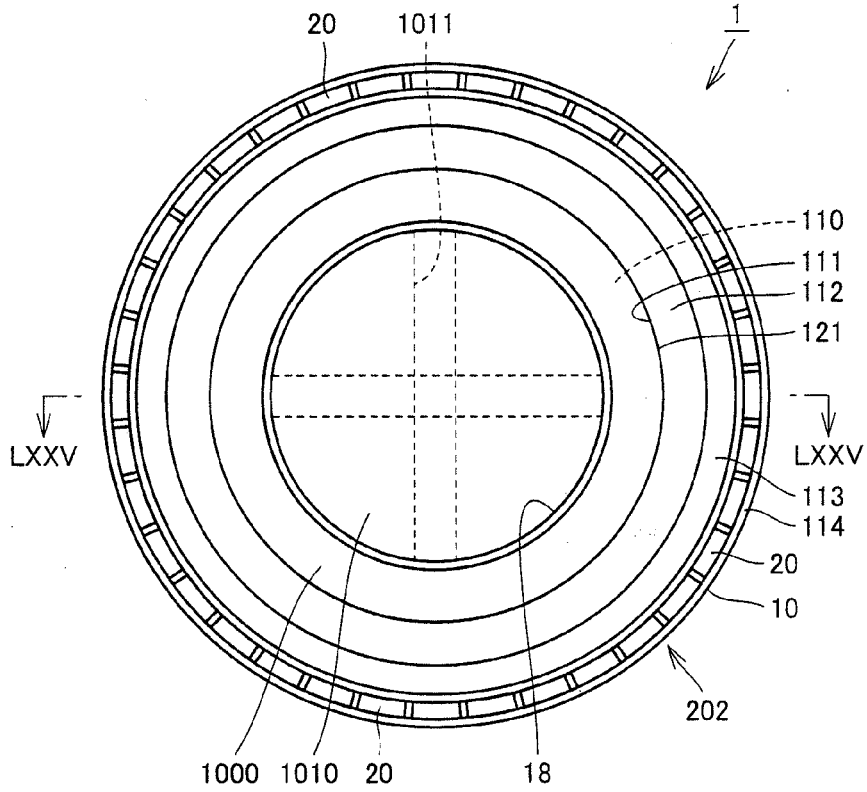
FIG. 74 is a bottom view of the super abrasive wheel according to a twenty-seventh embodiment of the invention.
Figure 75:
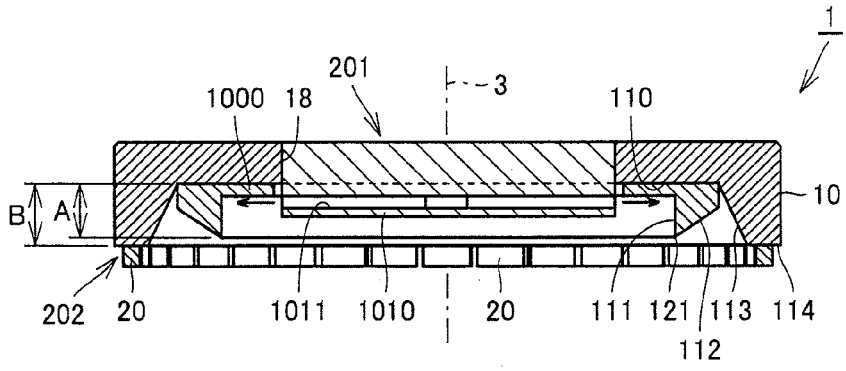
FIG. 75 is a cross-sectional view taken along a line LXXV-LXXV in FIG. 74.

FIG. 74 is a bottom view of the super abrasive wheel according to a twenty-seventh embodiment of the invention. FIG. 75 is a cross-sectional view taken along a line LXXV-LXXV in FIG. 74. Referring to FIG. 74 and FIG. 75, in super abrasive wheel 1 according to the twenty-seventh embodiment of the invention, baffle 1010 and grinding fluid passage 1011 are provided on a machine that rotates super abrasive wheel 1. The grinding fluid supplied from grinding fluid supply passage 1011 passes through first protrusion portion 121 to be supplied toward super abrasive layer 20.

Twenty-eighth Embodiment

Figure 76:
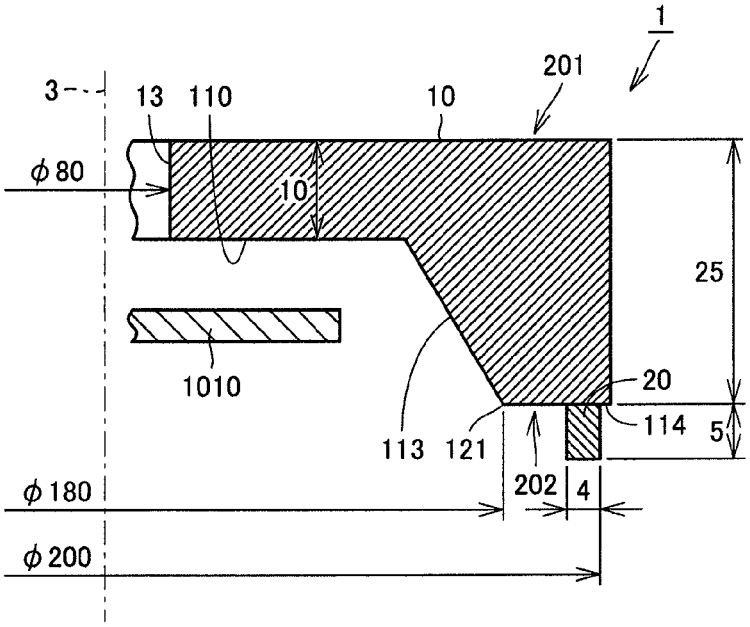
FIG. 76 is a cross-sectional view of a super abrasive wheel according to a comparative product.
Figure 77:
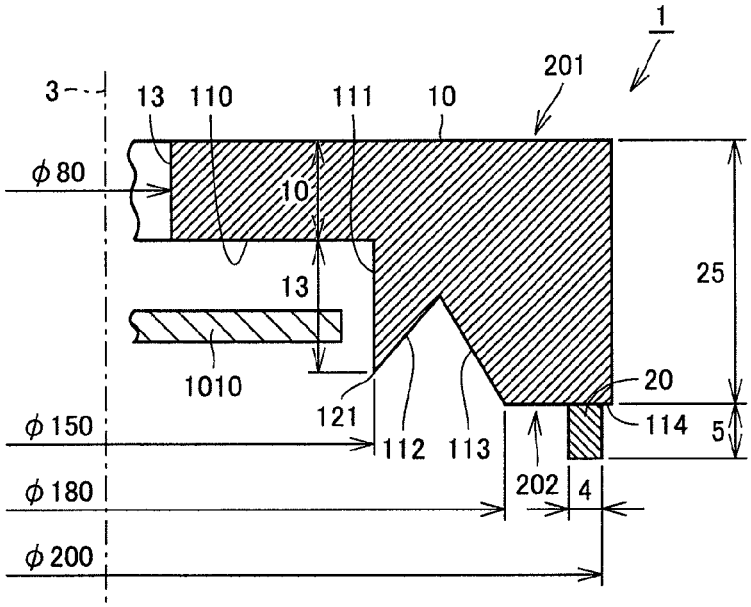
FIG. 77 is a cross-sectional view of a super abrasive wheel according to a product of the present invention.

FIG. 76 is a cross-sectional view of a super abrasive wheel according to a comparative product. FIG. 77 is a bottom view of a super abrasive wheel according to a product of the present invention. In a twenty-eighth embodiment, a comparative product (having no protrusion portion) having the shape shown in FIG. 76 and a product of the present invention (having the protrusion portion) having the shape shown in FIG. 77 were prepared. The sizes of these samples are shown below.

Size of super abrasive wheel: the outer diameter, 200 mm; the inner diameter of grinding fluid supply hole 13, 80 mm; the height from first surface 201 to the tip end of super abrasive layer 20, 30 mm; the width of the super abrasive layer, 4 mm; the height of the super abrasive layer, 5 mm Grain size of super abrasive layer 20: #8000

Work and the size thereof: a monocrystalline silicon wafer having a diameter of 200 mm Working Conditions Rotational speed of the super abrasive wheel: 2000 $min^{-1}$ (21 m/s)

Rotational speed of the table: 100 $min^{-1}$

Feeding speed: 20 μm/min

Depth of cut: 20 μm

Spark out: 30 sec

Grinding fluid: water

Grinding fluid supply: axial center supply+baffle

Flow rate: 5 $dm^3$/min

Number of works processed: twenty works in succession

In both samples, the grinding fluid was supplied from the axial center of the wheel spindle of the working machine. The grinding liquid (water) supplied from the axial center collided against baffle 1010 and scattered by rotation. Baffle 1010 was disc-shaped and fixed at four points.

In the comparative product shown in FIG. 76, the current value (A) required to rotate the super abrasive wheel was 3.5, the amount (μ) of wear of super abrasive layer 20 was 0.86, and the surface roughness Ra (nm) of the work was 2.0. By contrast, in super abrasive wheel 1 according to the present invention shown in FIG. 77, the current value (A) was 3.5, the amount of wear (μm) was 0.42, and the surface roughness Ra (nm) was 1.2.

The result of comparison suggested that the use of first protrusion portion 121 reduced the amount of wear and improved the surface roughness. There was no significant difference in current value. It can be assumed that the amount of wear was reduced and the surface roughness was improved because the grinding fluid supplied from the axial center was scattered at the baffle being rotated and was uniformly dispersed at the protrusion portion. In the comparative product, it can be assumed that the grinding fluid was not supplied uniformly to the grinding point because the grinding fluid was not uniformly scattered at the four points where the baffle was fixed. The use of the super abrasive wheel according to the present invention also reduced deep scratches on the worked surface of the wafer during successive working. It can be said that the stable ground surface could be obtained because the grinding fluid was uniformly dispersed by virtue of the protrusion portion and thus uniformly supplied to the grinding point.

Although the embodiments of the present invention have been described above, the embodiments shown here can be modified in various ways. A semiconductor wafer has been shown as a workpiece. However, the super abrasive wheel can be used to work on not only a wafer but also a variety of metals, non-metals, and organic and inorganic matters. Specifically, examples of the workpiece include glass substrates, compound semiconductors, silicon wafers, SiC wafers, carbon films (diamond-like carbon), silicon oxide films, silicon nitrides, and diamond. The shape of the working surface of super abrasive layer 20 is not limited to an approximate rectangle and an approximate parallelogram shown in the embodiments but may be a variety of shapes including triangular, circular and oval shapes, and a triangular shape with rounded corners.

The embodiments disclosed here should be understood as being illustrative rather than being limitative in all respects. The scope of the present invention is shown not in the foregoing description but in the claims, and it is intended that all modifications that come within the meaning and range of equivalence to the claims are embraced here.

INDUSTRIAL APPLICABILITY

The present invention can be used in the fields of a super abrasive wheel for grinding a workpiece and a method of manufacturing a wafer using the same.

REFERENCE SIGNS LIST

1 super abrasive wheel, 3 rotation axis, 10 core, 12 grinding fluid supply groove, 13 grinding fluid supply hole, 18 inner circumferential wall, 20 super abrasive layer, 110 reference surface, 111 first rising wall, 112 first inverted taper surface, 113 outer taper surface, 114 top portion, 115 end portion, 116 second rising wall, 117 second inverted taper surface, 121 first protrusion portion, 122 second protrusion portion, 125 end portion, 201 first surface, 202 second surface, 501 nozzle, 601 wafer, 602 rotary table, 1000 protrusion member.

The invention claimed is:

1. A super abrasive wheel comprising:

a core configured to rotate around a rotation axis; and a super abrasive layer bonded to the core, the core having a first surface and a second surface located opposite to the first surface, wherein an annular protrusion portion protruding in a direction away from the first surface is provided at a portion of the second surface that is surrounded with the super abrasive layer, a reference surface is provided at a portion of the second surface on the inside of the protrusion portion, a height from the reference surface to the protrusion portion is denoted as A, and a top portion having a height B from the reference surface is provided at a portion of the second surface between the protrusion portion and the super abrasive layer, wherein the height B is greater than the height A, said protrusion portion is formed by a rising wall that extends to the height A and an inverted taper surface that inclines from an intersection with the rising wall back toward the first surface to a height from the reference surface that is less than height A, in a direction toward a peripheral of said core, and grinding fluid is supplied to said core, the grinding fluid receives centrifugal force in the outward direction as said core rotates, the grinding fluid moves downward along said rising wall as it moves in the downward direction due to gravity, and the grinding fluid, passing through said rising wall, diffuses from said inverted taper surface.

2. The super abrasive wheel according to claim 1, wherein a wall surface on an inner circumferential side of the protrusion portion is approximately parallel to the rotation axis.

3. The super abrasive wheel according to claim 1, wherein a plurality of the protrusion portions are provided on an inner circumferential side of the super abrasive layer, and in the protrusion portions adjacent to each other, the height from the reference surface is lower in the protrusion portion on the inner circumferential side than in the protrusion portion on the outer circumferential side.

4. The super abrasive wheel according to claim 1, wherein the height A from the reference surface of the protrusion portion located on an innermost circumferential side is 3 mm or more.

5. The super abrasive wheel according to claim 1, wherein a difference between the height B and the height A is 1 mm or more.

6. The super abrasive wheel according to claim 1, wherein the protrusion portion is shaped like a circular ring.

7. The super abrasive wheel according to claim 1, wherein the protrusion portion has a function of making grinding fluid into finer particles and uniformly distributing the grinding fluid.

8. A method of manufacturing a wafer, comprising bringing the super abrasive layer of the super abrasive wheel of claim 1 into contact with a wafer and polishing the wafer while supplying grinding fluid from an inner circumferential side of the protrusion portion.

9. A wafer manufactured through the method of claim 8.

10. A super abrasive wheel comprising:

a core configured to rotate around a rotation axis;

a super abrasive layer bonded to the core, the core having a first surface and a second surface located opposite to the first surface; and a protrusion member provided at a portion of the second surface that is surrounded with the super abrasive layer, the protrusion member having an annular protrusion portion that protrudes in a direction away from the first surface, wherein a reference surface is provided at a portion of the second surface on the inside of the protrusion portion, a height from the reference surface to the protrusion portion is denoted as A, and a top portion having a height B from the reference surface is provided at a portion of the second surface between the protrusion portion and the super abrasive layer, wherein the height B is greater than the height A, said protrusion portion is formed by a rising wall that extends to the height A and an inverted taper surface that inclines from an intersection with the rising wall back toward the first surface to a height from a reference surface that is less than height A, in a direction toward a peripheral of said core, and grinding fluid is supplied to said core, the grinding fluid receives centrifugal force in the outward direction as said core rotates, the grinding fluid moves downward along said rising wall as it moves in the downward direction due to gravity, and the grinding fluid, passing through said rising wall, diffuses from said inverted taper surface.

11. The super abrasive wheel according to claim 10, wherein a wall surface on an inner circumferential side of the protrusion portion is approximately parallel to the rotation axis.

12. The super abrasive wheel according to claim 10, wherein a plurality of the protrusion portions are provided on an inner circumferential side of the super abrasive layer, and in the protrusion portions adjacent to each other, the height from the reference surface is lower in the protrusion portion on the inner circumferential side than in the protrusion portion on the outer circumferential side.

13. The super abrasive wheel according to claim 10, wherein the height A from the reference surface of the protrusion portion located on an innermost circumferential side is 3 mm or more.

14. The super abrasive wheel according to claim 10, wherein a difference between the height B and the height A is 1 mm or more.

15. The super abrasive wheel according to claim 10, wherein the protrusion portion is shaped like a circular ring.

16. The super abrasive wheel according to claim 10, wherein the protrusion portion has a function of making grinding fluid into finer particles and uniformly distributing the grinding fluid.

17. A method of manufacturing a wafer, comprising bringing the super abrasive layer of the super abrasive wheel of claim 10 into contact with a wafer and polishing the wafer while supplying grinding fluid from an inner circumferential side of the protrusion portion.

18. A wafer manufactured through the method of claim 17.

* * * * *

UNITED STATES PATENT AND TRADEMARK OFFICE

CERTIFICATE OF CORRECTION

PATENT NO. : 9,011,206 B2
APPLICATION NO. : 13/519210
DATED : April 21, 2015
INVENTOR(S) : Tomohiro Ishizu et al.

It is certified that error appears in the above-identified patent and that said Letters Patent is hereby corrected as shown below:

ON THE TITLE PAGE and IN THE SPECIFICATION:

At item (54) on the Title Page and at column 1, lines 1-4, correct the Title of the Invention to read as follows:

--SUPER ABRASIVE WHEEL, METHOD OF MANUFACTURING WAFER USING THE SAME, AND WAFER--.

Signed and Sealed this
Seventeenth Day of November, 2015

Michelle K. Lee

Michelle K. Lee
*Director of the United States Patent and Trademark Office*